US007325317B2

(12) United States Patent
Matchett et al.

(10) Patent No.: US 7,325,317 B2
(45) Date of Patent: Feb. 5, 2008

(54) METHODS FOR OPTIMALLY ADJUSTING MEASUREMENTS OF GARMENTS

(75) Inventors: Rebecca W. Matchett, New York, NY (US); Andrew S. Paluba, New York, NY (US); Christopher J. Matchett, New York, NY (US); Pauline Lock, New York, NY (US)

(73) Assignee: TrioFit, Inc., New York, NY (US)

( * ) Notice: Subject to any disclaimer, the term of this patent is extended or adjusted under 35 U.S.C. 154(b) by 119 days.

(21) Appl. No.: 11/446,468

(22) Filed: Jun. 2, 2006

(65) Prior Publication Data

US 2006/0277773 A1 Dec. 14, 2006

Related U.S. Application Data

(60) Provisional application No. 60/689,191, filed on Jun. 10, 2005.

(51) Int. Cl.
*A41H 3/00* (2006.01)

(52) U.S. Cl. ..... 33/17 A; 33/2 R; 33/14

(58) Field of Classification Search ..... 33/17 A, 33/17 R, 2 R, 5–6, 11–12, 14–16; 112/186; 700/132

See application file for complete search history.

(56) References Cited

U.S. PATENT DOCUMENTS 4,916,624 A 4/1990 Collins et al.
4,926,344 A * 5/1990 Collins et al. ..... 700/132
5,992,027 A * 11/1999 Mack ..... 33/12
6,978,549 B2 * 12/2005 Ellis ..... 33/17 R
7,092,782 B2 * 8/2006 Lee ..... 700/132
2004/0006878 A1 * 1/2004 Grove ..... 33/17 R
2004/0093105 A1 * 5/2004 Holloway et al. ..... 700/97
2005/0022708 A1 2/2005 Lee

FOREIGN PATENT DOCUMENTS

EP 801905 B1 10/1997

OTHER PUBLICATIONS

Bravissimo Ltd. website at http://www.bravissimo.com/bravissimo/, Printed from the Internet on Aug. 7, 2006.
Fit Technologies, Inc. website at http://fitlogic.net/, Printed from the Internet on Aug. 7, 2006.
Fashion-Incubator website at http://www.fashion-incubator.com/mt/archives/alternatives_in_womens_sizing.html, Printed from the Internet on Aug. 7, 2006.

* cited by examiner

*Primary Examiner*—Yaritza Guadalupe-McCall
(74) *Attorney, Agent, or Firm*—Ropes & Gray LLP; Jeffrey H. Ingerman

(57) ABSTRACT

The present invention relates to an outer garment that covers at least part of a wearer's upper body, such as a shirt or a shirt-dress, that has optimally adjusted measurements, and includes at least one measurement that changes based on physical characteristics of a wearer, such as bra measurement and height. For example, a master pattern may be designed in a chosen style for a chosen body type in the usual manner for an outer garment for a wearer of a specific bra measurement and height. The same outer garment in the same style for a wearer of the same body type and chest circumference but a different bra cup size and/or height may be defined by adjusting fewer than all measurements, based, for example, on an algorithm.

18 Claims, 38 Drawing Sheets

100

| Variable | Finished Measurements in Inches |
|---|---|
| a | Body Length (from High Point Shoulder) |
| b | High Point Shoulder to Apex |
| c | Chest Width (Front & Back combined) 1" below armhole |
| d | Bottom Width |
| e | Waist 7" below armhole |
| f | Cross Front 4" down from shoulder |
| g | Cross Shoulder (Top of Shoulder) |
| h | Cross Back 4" down from shoulder |
| i | Armhole Opening |
| j | Sleeve Length (from Center Back) |
| k | Armhole Bottom to Waist |
| l | Cuff Opening |
| m | Cuff Width |
| n | Sleeve Placket Length |
| o | Sleeve Placket Width |
| p | Back Neck Width |
| q | Front Neck Drop |
| r | Back Neck Drop |
| s | Collar Band Width at Center Back |
| t | Collar Width |
| u | Collar Spread |
| v | Center Front Placket Width |
| w | Yoke at Center Back |
| x | Sweep |

FIG. 1C c = Chest Width
(Front & Back Combined)

d = Bottom Width
g = Cross Shoulder
e = Waist f = Cross Front
h = Cross Back
i = Armhole Opening

| Variable | Chest Circumference Size 34 Measurements Description | Bra Cup Size: Slim Fit Shirt "Long" measurements in inches | | | | |
|---|---|---|---|---|---|---|
| | | A | B | C | D | DD |
| a | Body Length (from High Point Shoulder) | 24.875 | 25.000 | 25.125 | 25.250 | 25.375 |
| b | High Point Shoulder to Apex | 9.750 | 10.000 | 10.250 | 10.500 | 11.000 |
| c | Chest Width (Front & Back combined) 1" below armhole | 35.250 | 36.000 | 37.250 | 38.500 | 39.750 |
| d | Bottom Width | 38.000 | 38.500 | 39.000 | 39.500 | 40.250 |
| e | Waist 7" below armhole | 30.000 | 30.500 | 31.000 | 31.500 | 32.250 |
| f | Cross Front 4" down from shoulder | 12.625 | 12.750 | 12.875 | 13.000 | 13.125 |
| g | Cross Shoulder (Top of Shoulder) | 14.875 | 15.000 | 15.125 | 15.250 | 15.375 |
| h | Cross Back 4" down from shoulder | 13.625 | 13.750 | 13.875 | 14.000 | 14.125 |
| i | Armhole Opening | 18.875 | 19.000 | 19.125 | 19.250 | 19.375 |
| j | Sleeve Length (from Center Back) | 32.000 | 32.000 | 32.000 | 32.000 | 32.000 |
| k | Armhole Bottom to Waist | 7.000 | 7.000 | 7.000 | 7.000 | 7.000 |
| l | Cuff Opening | 8.000 | 8.000 | 8.000 | 8.000 | 8.000 |
| m | Cuff Width | 3.000 | 3.000 | 3.000 | 3.000 | 3.000 |
| n | Sleeve Placket Length | 4.000 | 4.000 | 4.000 | 4.000 | 4.000 |
| o | Sleeve Placket Width | 0.875 | 0.875 | 0.875 | 0.875 | 0.875 |
| p | Back Neck Width | 6.250 | 6.250 | 6.250 | 6.250 | 6.250 |
| q | Front Neck Drop | 2.000 | 2.000 | 2.000 | 2.000 | 2.000 |
| r | Back Neck Drop | 0.500 | 0.500 | 0.500 | 0.500 | 0.500 |
| s | Collar Band Width at Center Back | 1.250 | 1.250 | 1.250 | 1.250 | 1.250 |
| t | Collar Width | 3.000 | 3.000 | 3.000 | 3.000 | 3.000 |
| u | Collar Spread | 3.250 | 3.250 | 3.250 | 3.250 | 3.250 |
| v | Center Front Placket Width | 1.250 | 1.250 | 1.250 | 1.250 | 1.250 |
| w | Yoke at Center Back | 3.000 | 3.000 | 3.000 | 3.000 | 3.000 |
| x | Sweep | N/A | N/A | N/A | N/A | N/A |

FIG. 6

| | | Bra Measurement | | | | | |
|---|---|---|---|---|---|---|---|
| | | A | | | | | |
| Variable | Slim Fit Shirt "Petite" Measurements (total inches) | 30 | 32 | 34 | 36 | 38 | 40 |
| a | Body Length (from High Point Shoulder) | 20.625 | 21.000 | 21.375 | 21.750 | 22.125 | 22.500 |
| b | High Point Shoulder to Apex | 8.875 | 8.875 | 8.875 | 8.875 | 8.875 | 8.875 |
| c | Chest Width (Front & Back combined) 1" below armhole | 31.250 | 33.250 | 35.250 | 37.250 | 39.250 | 41.250 |
| d | Bottom Width | 34.000 | 36.000 | 38.000 | 40.000 | 42.000 | 44.000 |
| e | Waist 7" below armhole | 26.000 | 28.000 | 30.000 | 32.000 | 34.000 | 36.000 |
| f | Cross Front 4" down from shoulder | 12.125 | 12.375 | 12.625 | 12.875 | 13.125 | 13.375 |
| g | Cross Shoulder (Top of Shoulder) | 14.375 | 14.625 | 14.875 | 15.125 | 15.375 | 15.750 |
| h | Cross Back 4" down from shoulder | 13.125 | 13.375 | 13.625 | 13.875 | 14.125 | 14.375 |
| i | Armhole Opening | 17.875 | 18.375 | 18.875 | 19.375 | 19.875 | 20.375 |
| j | Sleeve Length (from Center Back) | 27.750 | 28.125 | 28.500 | 28.875 | 29.250 | 29.625 |
| k | Armhole Bottom to Waist | 5.250 | 5.250 | 5.250 | 5.250 | 5.250 | 5.250 |
| l | Cuff Opening | 7.750 | 7.875 | 8.000 | 8.125 | 8.250 | 8.375 |
| m | Cuff Width | 3.000 | 3.000 | 3.000 | 3.000 | 3.000 | 3.000 |
| n | Sleeve Placket Length | 4.000 | 4.000 | 4.000 | 4.000 | 4.000 | 4.000 |
| o | Sleeve Placket Width | 0.875 | 0.875 | 0.875 | 0.875 | 0.875 | 0.875 |
| p | Back Neck Width | 6.000 | 6.125 | 6.250 | 6.375 | 6.500 | 6.625 |
| q | Front Neck Drop | 1.750 | 1.875 | 2.000 | 2.125 | 2.250 | 2.375 |
| r | Back Neck Drop | 0.500 | 0.500 | 0.500 | 0.500 | 0.500 | 0.500 |
| s | Collar Band Width at Center Back | 1.250 | 1.250 | 1.250 | 1.250 | 1.250 | 1.250 |
| t | Collar Width | 3.000 | 3.000 | 3.000 | 3.000 | 3.000 | 3.000 |
| u | Collar Spread | 3.250 | 3.250 | 3.250 | 3.250 | 3.250 | 3.250 |
| v | Center Front Placket Width | 1.250 | 1.250 | 1.250 | 1.250 | 1.250 | 1.250 |
| w | Yoke at Center Back | 3.000 | 3.000 | 3.000 | 3.000 | 3.000 | 3.000 |
| x | Sweep | n/a | n/a | n/a | n/a | n/a | n/a |

FIG. 7A

| | | Bra Measurement | | | | | |
|---|---|---|---|---|---|---|---|
| | | B | | | | | |
| Variable | Slim Fit Shirt "Petite" Measurements (total inches) | 30 | 32 | 34 | 36 | 38 | 40 |
| a | Body Length (from High Point Shoulder) | 20.750 | 21.125 | 21.500 | 21.875 | 22.250 | 22.625 |
| b | High Point Shoulder to Apex | 9.125 | 9.125 | 9.125 | 9.125 | 9.125 | 9.125 |
| c | Chest Width (Front & Back combined) 1" below armhole | 32.000 | 34.000 | 36.000 | 38.000 | 40.000 | 42.000 |
| d | Bottom Width | 34.500 | 36.500 | 38.500 | 40.500 | 42.500 | 44.500 |
| e | Waist 7" below armhole | 26.500 | 28.500 | 30.500 | 32.500 | 34.500 | 36.500 |
| f | Cross Front 4" down from shoulder | 12.250 | 12.500 | 12.750 | 13.000 | 13.250 | 13.500 |
| g | Cross Shoulder (Top of Shoulder) | 14.500 | 14.750 | 15.000 | 15.250 | 15.500 | 15.875 |
| h | Cross Back 4" down from shoulder | 13.250 | 13.500 | 13.750 | 14.000 | 14.250 | 14.500 |
| i | Armhole Opening | 18.000 | 18.500 | 19.000 | 19.500 | 20.000 | 20.500 |
| j | Sleeve Length (from Center Back) | 27.750 | 28.125 | 28.500 | 28.875 | 29.250 | 29.625 |
| k | Armhole Bottom to Waist | 5.250 | 5.250 | 5.250 | 5.250 | 5.250 | 5.250 |
| l | Cuff Opening | 7.750 | 7.875 | 8.000 | 8.125 | 8.250 | 8.375 |
| m | Cuff Width | 3.000 | 3.000 | 3.000 | 3.000 | 3.000 | 3.000 |
| n | Sleeve Placket Length | 4.000 | 4.000 | 4.000 | 4.000 | 4.000 | 4.000 |
| o | Sleeve Placket Width | 0.875 | 0.875 | 0.875 | 0.875 | 0.875 | 0.875 |
| p | Back Neck Width | 6.000 | 6.125 | 6.250 | 6.375 | 6.500 | 6.625 |
| q | Front Neck Drop | 1.750 | 1.875 | 2.000 | 2.125 | 2.250 | 2.375 |
| r | Back Neck Drop | 0.500 | 0.500 | 0.500 | 0.500 | 0.500 | 0.500 |
| s | Collar Band Width at Center Back | 1.250 | 1.250 | 1.250 | 1.250 | 1.250 | 1.250 |
| t | Collar Width | 3.000 | 3.000 | 3.000 | 3.000 | 3.000 | 3.000 |
| u | Collar Spread | 3.250 | 3.250 | 3.250 | 3.250 | 3.250 | 3.250 |
| v | Center Front Placket Width | 1.250 | 1.250 | 1.250 | 1.250 | 1.250 | 1.250 |
| w | Yoke at Center Back | 3.000 | 3.000 | 3.000 | 3.000 | 3.000 | 3.000 |
| x | Sweep | n/a | n/a | n/a | n/a | n/a | n/a |

FIG. 7B

| | | Bra Measurement | | | | | |
|---|---|---|---|---|---|---|---|
| | | C | | | | | |
| Variable | Slim Fit Shirt "Petite" Measurements (total inches) | 30 | 32 | 34 | 36 | 38 | 40 |
| a | Body Length (from High Point Shoulder) | 20.875 | 21.250 | 21.625 | 22.000 | 22.375 | 22.750 |
| b | High Point Shoulder to Apex | 9.375 | 9.375 | 9.375 | 9.375 | 9.375 | 9.375 |
| c | Chest Width (Front & Back combined) 1" below armhole | 33.250 | 35.250 | 37.250 | 39.250 | 41.250 | 43.250 |
| d | Bottom Width | 35.000 | 37.000 | 39.000 | 41.000 | 43.000 | 45.000 |
| e | Waist 7" below armhole | 27.000 | 29.000 | 31.000 | 33.000 | 35.000 | 37.000 |
| f | Cross Front 4" down from shoulder | 12.375 | 12.625 | 12.875 | 13.125 | 13.375 | 13.625 |
| g | Cross Shoulder (Top of Shoulder) | 14.625 | 14.875 | 15.125 | 15.375 | 15.625 | 16.000 |
| h | Cross Back 4" down from shoulder | 13.375 | 13.625 | 13.875 | 14.125 | 14.375 | 14.625 |
| i | Armhole Opening | 18.125 | 18.625 | 19.125 | 19.625 | 20.125 | 20.625 |
| j | Sleeve Length (from Center Back) | 27.750 | 28.125 | 28.500 | 28.875 | 29.250 | 29.625 |
| k | Armhole Bottom to Waist | 5.250 | 5.250 | 5.250 | 5.250 | 5.250 | 5.250 |
| l | Cuff Opening | 7.750 | 7.875 | 8.000 | 8.125 | 8.250 | 8.375 |
| m | Cuff Width | 3.000 | 3.000 | 3.000 | 3.000 | 3.000 | 3.000 |
| n | Sleeve Placket Length | 4.000 | 4.000 | 4.000 | 4.000 | 4.000 | 4.000 |
| o | Sleeve Placket Width | 0.875 | 0.875 | 0.875 | 0.875 | 0.875 | 0.875 |
| p | Back Neck Width | 6.000 | 6.125 | 6.250 | 6.375 | 6.500 | 6.625 |
| q | Front Neck Drop | 1.750 | 1.875 | 2.000 | 2.125 | 2.250 | 2.375 |
| r | Back Neck Drop | 0.500 | 0.500 | 0.500 | 0.500 | 0.500 | 0.500 |
| s | Collar Band Width at Center Back | 1.250 | 1.250 | 1.250 | 1.250 | 1.250 | 1.250 |
| t | Collar Width | 3.000 | 3.000 | 3.000 | 3.000 | 3.000 | 3.000 |
| u | Collar Spread | 3.250 | 3.250 | 3.250 | 3.250 | 3.250 | 3.250 |
| v | Center Front Placket Width | 1.250 | 1.250 | 1.250 | 1.250 | 1.250 | 1.250 |
| w | Yoke at Center Back | 3.000 | 3.000 | 3.000 | 3.000 | 3.000 | 3.000 |
| x | Sweep | n/a | n/a | n/a | n/a | n/a | n/a |

FIG. 7C

| | | Bra Measurement | | | | | |
|---|---|---|---|---|---|---|---|
| | | D | | | | | |
| Variable | Slim Fit Shirt "Petite" Measurements (total inches) | 30 | 32 | 34 | 36 | 38 | 40 |
| a | Body Length (from High Point Shoulder) | 21.000 | 21.375 | 21.750 | 22.125 | 22.500 | 22.875 |
| b | High Point Shoulder to Apex | 9.625 | 9.625 | 9.625 | 9.625 | 9.625 | 9.625 |
| c | Chest Width (Front & Back combined) 1" below armhole | 34.500 | 36.500 | 38.500 | 40.500 | 42.500 | 44.500 |
| d | Bottom Width | 35.500 | 37.500 | 39.500 | 41.500 | 43.500 | 45.500 |
| e | Waist 7" below armhole | 27.500 | 29.500 | 31.500 | 33.500 | 35.500 | 37.500 |
| f | Cross Front 4" down from shoulder | 12.500 | 12.750 | 13.000 | 13.250 | 13.500 | 13.750 |
| g | Cross Shoulder (Top of Shoulder) | 14.750 | 15.000 | 15.250 | 15.500 | 15.750 | 16.125 |
| h | Cross Back 4" down from shoulder | 13.500 | 13.750 | 14.000 | 14.250 | 14.500 | 14.750 |
| i | Armhole Opening | 18.250 | 18.750 | 19.250 | 19.750 | 20.250 | 20.750 |
| j | Sleeve Length (from Center Back) | 27.750 | 28.125 | 28.500 | 28.875 | 29.250 | 29.625 |
| k | Armhole Bottom to Waist | 5.250 | 5.250 | 5.250 | 5.250 | 5.250 | 5.250 |
| l | Cuff Opening | 7.750 | 7.875 | 8.000 | 8.125 | 8.250 | 8.375 |
| m | Cuff Width | 3.000 | 3.000 | 3.000 | 3.000 | 3.000 | 3.000 |
| n | Sleeve Placket Length | 4.000 | 4.000 | 4.000 | 4.000 | 4.000 | 4.000 |
| o | Sleeve Placket Width | 0.875 | 0.875 | 0.875 | 0.875 | 0.875 | 0.875 |
| p | Back Neck Width | 6.000 | 6.125 | 6.250 | 6.375 | 6.500 | 6.625 |
| q | Front Neck Drop | 1.750 | 1.875 | 2.000 | 2.125 | 2.250 | 2.375 |
| r | Back Neck Drop | 0.500 | 0.500 | 0.500 | 0.500 | 0.500 | 0.500 |
| s | Collar Band Width at Center Back | 1.250 | 1.250 | 1.250 | 1.250 | 1.250 | 1.250 |
| t | Collar Width | 3.000 | 3.000 | 3.000 | 3.000 | 3.000 | 3.000 |
| u | Collar Spread | 3.250 | 3.250 | 3.250 | 3.250 | 3.250 | 3.250 |
| v | Center Front Placket Width | 1.250 | 1.250 | 1.250 | 1.250 | 1.250 | 1.250 |
| w | Yoke at Center Back | 3.000 | 3.000 | 3.000 | 3.000 | 3.000 | 3.000 |
| x | Sweep | n/a | n/a | n/a | n/a | n/a | n/a |

FIG. 7D

| | | Bra Measurement | | | | | |
|---|---|---|---|---|---|---|---|
| | | DD | | | | | |
| Variable | Slim Fit Shirt "Petite" Measurements (total inches) | 30 | 32 | 34 | 36 | 38 | 40 |
| a | Body Length (from High Point Shoulder) | 21.125 | 21.500 | 21.875 | 22.250 | 22.625 | 23.000 |
| b | High Point Shoulder to Apex | 10.125 | 10.125 | 10.125 | 10.125 | 10.125 | 10.125 |
| c | Chest Width (Front & Back combined) 1" below armhole | 35.750 | 37.750 | 39.750 | 41.750 | 43.750 | 45.750 |
| d | Bottom Width | 36.250 | 38.250 | 40.250 | 42.250 | 44.250 | 46.250 |
| e | Waist 7" below armhole | 28.250 | 30.250 | 32.250 | 34.250 | 36.250 | 38.250 |
| f | Cross Front 4" down from shoulder | 12.625 | 12.875 | 13.125 | 13.375 | 13.625 | 13.875 |
| g | Cross Shoulder (Top of Shoulder) | 14.875 | 15.125 | 15.375 | 15.625 | 15.875 | 16.250 |
| h | Cross Back 4" down from shoulder | 13.625 | 13.875 | 14.125 | 14.375 | 14.625 | 14.875 |
| i | Armhole Opening | 18.375 | 18.875 | 19.375 | 19.875 | 20.375 | 20.875 |
| j | Sleeve Length (from Center Back) | 27.750 | 28.125 | 28.500 | 28.875 | 29.250 | 29.625 |
| k | Armhole Bottom to Waist | 5.250 | 5.250 | 5.250 | 5.250 | 5.250 | 5.250 |
| l | Cuff Opening | 7.750 | 7.875 | 8.000 | 8.125 | 8.250 | 8.375 |
| m | Cuff Width | 3.000 | 3.000 | 3.000 | 3.000 | 3.000 | 3.000 |
| n | Sleeve Placket Length | 4.000 | 4.000 | 4.000 | 4.000 | 4.000 | 4.000 |
| o | Sleeve Placket Width | 0.875 | 0.875 | 0.875 | 0.875 | 0.875 | 0.875 |
| p | Back Neck Width | 6.000 | 6.125 | 6.250 | 6.375 | 6.500 | 6.625 |
| q | Front Neck Drop | 1.750 | 1.875 | 2.000 | 2.125 | 2.250 | 2.375 |
| r | Back Neck Drop | 0.500 | 0.500 | 0.500 | 0.500 | 0.500 | 0.500 |
| s | Collar Band Width at Center Back | 1.250 | 1.250 | 1.250 | 1.250 | 1.250 | 1.250 |
| t | Collar Width | 3.000 | 3.000 | 3.000 | 3.000 | 3.000 | 3.000 |
| u | Collar Spread | 3.250 | 3.250 | 3.250 | 3.250 | 3.250 | 3.250 |
| v | Center Front Placket Width | 1.250 | 1.250 | 1.250 | 1.250 | 1.250 | 1.250 |
| w | Yoke at Center Back | 3.000 | 3.000 | 3.000 | 3.000 | 3.000 | 3.000 |
| x | Sweep | n/a | n/a | n/a | n/a | n/a | n/a |

FIG. 7E

| | | Bra Cup Size | | | | |
|---|---|---|---|---|---|---|
| | | Rebecca & Drew Slim Fit Shirt "Long" Measurements in inches | | | | |
| Variable | Chest Circumference Size 34 Description | A | B | C | D | DD |
| a | Body Length (from High Point Shoulder) | (0.5%) | 25.000 | 0.5% | 1.0% | 1.5% |
| b | High Point Shoulder to Apex | (2.5%) | 10.000 | 2.5% | 4.9% | 9.7% |
| c | Chest Width (Front & Back combined) 1" below armhole | (2.1%) | 36.000 | 3.5% | 6.8% | 10.1% |
| d | Bottom Width | (1.3%) | 38.500 | 1.3% | 2.6% | 4.5% |
| e | Waist 7" below armhole | (1.6%) | 30.500 | 1.6% | 3.3% | 5.6% |
| f | Cross Front 4" down from shoulder | (1.0%) | 12.750 | 1.0% | 2.0% | 2.9% |
| g | Cross Shoulder (Top of Shoulder) | (0.8%) | 15.000 | 0.8% | 1.7% | 2.5% |
| h | Cross Back 4" down from shoulder | (0.9%) | 13.750 | 0.9% | 1.8% | 2.7% |
| i | Armhole Opening | (0.7%) | 19.000 | 0.7% | 1.3% | 2.0% |
| j | Sleeve Length (from Center Back) | 0.0% | 32.000 | 0.0% | 0.0% | 0.0% |
| k | Armhole Bottom to Waist | 0.0% | 7.000 | 0.0% | 0.0% | 0.0% |
| l | Cuff Opening | 0.0% | 8.000 | 0.0% | 0.0% | 0.0% |
| m | Cuff Width | 0.0% | 3.000 | 0.0% | 0.0% | 0.0% |
| n | Sleeve Placket Length | 0.0% | 4.000 | 0.0% | 0.0% | 0.0% |
| o | Sleeve Placket Width | 0.0% | 0.875 | 0.0% | 0.0% | 0.0% |
| p | Back Neck Width | 0.0% | 6.250 | 0.0% | 0.0% | 0.0% |
| q | Front Neck Drop | 0.0% | 2.000 | 0.0% | 0.0% | 0.0% |
| r | Back Neck Drop | 0.0% | 0.500 | 0.0% | 0.0% | 0.0% |
| s | Collar Band Width at Center Back | 0.0% | 1.250 | 0.0% | 0.0% | 0.0% |
| t | Collar Width | 0.0% | 3.000 | 0.0% | 0.0% | 0.0% |
| u | Collar Spread | 0.0% | 3.250 | 0.0% | 0.0% | 0.0% |
| v | Center Front Placket Width | 0.0% | 1.250 | 0.0% | 0.0% | 0.0% |
| w | Yoke at Center Back | 0.0% | 3.000 | 0.0% | 0.0% | 0.0% |
| x | Sweep | 0.0% | 0.000 | 0.0% | 0.0% | 0.0% |

FIG. 8A

| | | Bra Cup Size | | | | |
|---|---|---|---|---|---|---|
| | | Rebecca & Drew Relaxed Fit Shirt "Long" Measurements in inches | | | | |
| Variable | Chest Circumference Size 34 Description | A | B | C | D | DD |
| a | Body Length (from High Point Shoulder) | (0.5%) | 25.000 | 0.5% | 1.0% | 1.5% |
| b | High Point Shoulder to Apex | (2.5%) | 10.000 | 3.8% | 7.4% | 12.0% |
| c | Chest Width (Front & Back combined) 1" below armhole | (1.9%) | 38.500 | 3.2% | 6.4% | 9.4% |
| d | Bottom Width | (1.2%) | 43.000 | 1.2% | 2.3% | 4.0% |
| e | Waist 7" below armhole | (1.3%) | 37.500 | 1.3% | 2.6% | 4.6% |
| f | Cross Front 4" down from shoulder | (1.0%) | 12.750 | 1.0% | 2.0% | 2.9% |
| g | Cross Shoulder (Top of Shoulder) | (0.8%) | 15.000 | 0.8% | 1.7% | 2.5% |
| h | Cross Back 4" down from shoulder | (0.9%) | 13.750 | 0.9% | 1.8% | 2.7% |
| i | Armhole Opening | (0.7%) | 19.000 | 0.7% | 1.3% | 2.0% |
| j | Sleeve Length (from Center Back) | 0.0% | 32.000 | 0.0% | 0.0% | 0.0% |
| k | Armhole Bottom to Waist | 0.0% | 7.000 | 0.0% | 0.0% | 0.0% |
| l | Cuff Opening | 0.0% | 8.125 | 0.0% | 0.0% | 0.0% |
| m | Cuff Width | 0.0% | 3.000 | 0.0% | 0.0% | 0.0% |
| n | Sleeve Placket Length | 0.0% | 4.000 | 0.0% | 0.0% | 0.0% |
| o | Sleeve Placket Width | 0.0% | 0.875 | 0.0% | 0.0% | 0.0% |
| p | Back Neck Width | 0.0% | 6.375 | 0.0% | 0.0% | 0.0% |
| q | Front Neck Drop | 0.0% | 2.125 | 0.0% | 0.0% | 0.0% |
| r | Back Neck Drop | 0.0% | 0.500 | 0.0% | 0.0% | 0.0% |
| s | Collar Band Width at Center Back | 0.0% | 1.250 | 0.0% | 0.0% | 0.0% |
| t | Collar Width | 0.0% | 3.000 | 0.0% | 0.0% | 0.0% |
| u | Collar Spread | 0.0% | 3.250 | 0.0% | 0.0% | 0.0% |
| v | Center Front Placket Width | 0.0% | 1.250 | 0.0% | 0.0% | 0.0% |
| w | Yoke at Center Back | 0.0% | 3.000 | 0.0% | 0.0% | 0.0% |
| x | Sweep | 0.0% | 0.000 | 0.0% | 0.0% | 0.0% |

FIG. 8B

| | | Bra Cup Size | | | | |
|---|---|---|---|---|---|---|
| | | Rebecca & Drew Halter Shirt "Long" Measurements in inches | | | | |
| Variable | Chest Circumference Size 34 Description | A | B | C | D | DD |
| a | Body Length (from High Point Shoulder) | (0.6%) | 22.000 | 0.6% | 1.1% | 1.7% |
| b | High Point Shoulder to Apex | (2.5%) | 10.000 | 2.5% | 4.9% | 9.7% |
| c | Chest Width (Front & Back combined) 1" below armhole | (2.1%) | 36.000 | 3.5% | 6.8% | 10.1% |
| d | Bottom Width | (1.4%) | 36.000 | 1.4% | 2.8% | 4.8% |
| e | Waist 7" below armhole | (1.7%) | 29.500 | 1.7% | 3.4% | 5.8% |
| f | Cross Front 4" down from shoulder | 0.0% | 0.000 | 0.0% | 0.0% | 0.0% |
| g | Cross Shoulder (Top of Shoulder) | 0.0% | 0.000 | 0.0% | 0.0% | 0.0% |
| h | Cross Back 4" down from shoulder | 0.0% | 0.000 | 0.0% | 0.0% | 0.0% |
| i | Armhole Opening | 0.0% | 0.000 | 0.0% | 0.0% | 0.0% |
| j | Sleeve Length (from Center Back) | 0.0% | 0.000 | 0.0% | 0.0% | 0.0% |
| k | Armhole Bottom to Waist | 0.0% | 0.000 | 0.0% | 0.0% | 0.0% |
| l | Cuff Opening | 0.0% | 0.000 | 0.0% | 0.0% | 0.0% |
| m | Cuff Width | 0.0% | 0.000 | 0.0% | 0.0% | 0.0% |
| n | Sleeve Placket Length | 0.0% | 0.000 | 0.0% | 0.0% | 0.0% |
| o | Sleeve Placket Width | 0.0% | 0.000 | 0.0% | 0.0% | 0.0% |
| p | Back Neck Width | 0.0% | 0.000 | 0.0% | 0.0% | 0.0% |
| q | Front Neck Drop | 0.0% | 9.000 | 0.0% | 0.0% | 0.0% |
| r | Back Neck Drop | 0.0% | 0.000 | 0.0% | 0.0% | 0.0% |
| s | Collar Band Width at Center Back | 0.0% | 0.000 | 0.0% | 0.0% | 0.0% |
| t | Collar Width | 0.0% | 0.000 | 0.0% | 0.0% | 0.0% |
| u | Collar Spread | 0.0% | 0.000 | 0.0% | 0.0% | 0.0% |
| v | Center Front Placket Width | 0.0% | 0.000 | 0.0% | 0.0% | 0.0% |
| w | Yoke at Center Back | 0.0% | 0.000 | 0.0% | 0.0% | 0.0% |
| x | Sweep | 0.0% | 0.000 | 0.0% | 0.0% | 0.0% |

FIG. 8C

| | | Bra Cup Size | | | | |
|---|---|---|---|---|---|---|
| | | Sophie Hudson Missy Fit 10007 Shirt "Long" Measurements in inches | | | | |
| Variable | Chest Circumference Size 34 Measurements Description | A | B | C | D | DD |
| a | Body Length (from High Point Shoulder) | (0.5%) | 24.125 | 0.5% | 1.0% | 1.5% |
| b | High Point Shoulder to Apex | (2.3%) | 11.000 | 2.3% | 4.5% | 8.8% |
| c | Chest Width (Front & Back combined) 1" below armhole | (2.0%) | 38.000 | 3.3% | 6.5% | 9.6% |
| d | Bottom Width | (1.3%) | 39.000 | 1.3% | 2.5% | 4.4% |
| e | Waist 7" below armhole | (1.6%) | 31.000 | 1.6% | 3.2% | 5.5% |
| f | Cross Front 4" down from shoulder | (1.0%) | 12.750 | 1.0% | 2.0% | 2.9% |
| g | Cross Shoulder (Top of Shoulder) | (0.9%) | 14.250 | 0.9% | 1.7% | 2.6% |
| h | Cross Back 4" down from shoulder | (0.9%) | 13.750 | 0.9% | 1.8% | 2.7% |
| i | Armhole Opening | (0.7%) | 18.000 | 0.7% | 1.4% | 2.1% |
| j | Sleeve Length (from Center Back) | 0.0% | 31.125 | 0.0% | 0.0% | 0.0% |
| k | Armhole Bottom to Waist | 0.0% | 7.000 | 0.0% | 0.0% | 0.0% |
| l | Cuff Opening | 0.0% | 7.875 | 0.0% | 0.0% | 0.0% |
| m | Cuff Width | 0.0% | 3.000 | 0.0% | 0.0% | 0.0% |
| n | Sleeve Placket Length | 0.0% | 5.000 | 0.0% | 0.0% | 0.0% |
| o | Sleeve Placket Width | 0.0% | 0.875 | 0.0% | 0.0% | 0.0% |
| p | Back Neck Width | 0.0% | 7.125 | 0.0% | 0.0% | 0.0% |
| q | Front Neck Drop | 0.0% | 1.875 | 0.0% | 0.0% | 0.0% |
| r | Back Neck Drop | 0.0% | 0.500 | 0.0% | 0.0% | 0.0% |
| s | Collar Band Width at Center Back | 0.0% | 1.125 | 0.0% | 0.0% | 0.0% |
| t | Collar Width | 0.0% | 3.000 | 0.0% | 0.0% | 0.0% |
| u | Collar Spread | 0.0% | 3.250 | 0.0% | 0.0% | 0.0% |
| v | Center Front Placket Width | 0.0% | 1.250 | 0.0% | 0.0% | 0.0% |
| w | Yoke at Center Back | 0.0% | 3.000 | 0.0% | 0.0% | 0.0% |
| x | Sweep | 0.0% | 0.000 | 0.0% | 0.0% | 0.0% |

FIG. 8D

| | | Bra Cup Size | | | | |
|---|---|---|---|---|---|---|
| | | Sophie Hudson Missy Fit 10008 Shirt "Long" Measurements in inches | | | | |
| Variable | Chest Circumference Size 34 Measurements Description | A | B | C | D | DD |
| a | Body Length (from High Point Shoulder) | (1.0%) | 25.125 | 1.0% | 2.0% | 3.0% |
| b | High Point Shoulder to Apex | (2.4%) | 10.250 | 2.4% | 4.8% | 9.5% |
| c | Chest Width (Front & Back combined) 1" below armhole | (0.7%) | 37.500 | 3.3% | 6.6% | 9.7% |
| d | Bottom Width | (1.3%) | 40.000 | 1.3% | 2.5% | 4.3% |
| e | Waist 7" below armhole | (1.5%) | 33.500 | 1.5% | 3.0% | 5.1% |
| f | Cross Front 4" down from shoulder | (0.9%) | 13.750 | 0.9% | 1.8% | 2.7% |
| g | Cross Shoulder (Top of Shoulder) | (0.8%) | 15.000 | 0.8% | 1.7% | 2.5% |
| h | Cross Back 4" down from shoulder | (0.8%) | 14.750 | 0.8% | 1.7% | 2.5% |
| i | Armhole Opening | (0.7%) | 19.000 | 0.7% | 1.3% | 2.0% |
| j | Sleeve Length (from Center Back) | 0.0% | 31.625 | 0.0% | 0.0% | 0.0% |
| k | Armhole Bottom to Waist | 0.0% | 7.000 | 0.0% | 0.0% | 0.0% |
| l | Cuff Opening | 0.0% | 7.875 | 0.0% | 0.0% | 0.0% |
| m | Cuff Width | 0.0% | 3.000 | 0.0% | 0.0% | 0.0% |
| n | Sleeve Placket Length | 0.0% | 4.500 | 0.0% | 0.0% | 0.0% |
| o | Sleeve Placket Width | 0.0% | 0.875 | 0.0% | 0.0% | 0.0% |
| p | Back Neck Width | 0.0% | 5.875 | 0.0% | 0.0% | 0.0% |
| q | Front Neck Drop | 0.0% | 2.875 | 0.0% | 0.0% | 0.0% |
| r | Back Neck Drop | 0.0% | 0.250 | 0.0% | 0.0% | 0.0% |
| s | Collar Band Width at Center Back | 0.0% | 0.875 | 0.0% | 0.0% | 0.0% |
| t | Collar Width | 0.0% | 0.000 | 0.0% | 0.0% | 0.0% |
| u | Collar Spread | 0.0% | 0.000 | 0.0% | 0.0% | 0.0% |
| v | Center Front Placket Width | 0.0% | 0.000 | 0.0% | 0.0% | 0.0% |
| w | Yoke at Center Back | 0.0% | 1.250 | 0.0% | 0.0% | 0.0% |
| x | Sweep | 0.0% | 0.000 | 0.0% | 0.0% | 0.0% |

FIG. 8E

| | | Bra Cup Size | | | | |
|---|---|---|---|---|---|---|
| | | Sophie Hudson Women's Fit 10007 Shirt "Long" Measurements in inches | | | | |
| Variable | Chest Circumference Size 34 Measurements Description | A | B | C | D | DD |
| a | Body Length (from High Point Shoulder) | 99.5% | 26.250 | 100.5% | 101.4% | 102.4% |
| b | High Point Shoulder to Apex | 97.7% | 10.750 | 104.7% | 109.1% | 113.4% |
| c | Chest Width (Front & Back combined) 1" below armhole | 97.1% | 42.750 | 102.9% | 105.8% | 108.0% |
| d | Bottom Width | 98.9% | 45.500 | 101.1% | 102.7% | 104.3% |
| e | Waist 7" below armhole | 98.7% | 37.500 | 101.3% | 103.3% | 105.2% |
| f | Cross Front 4" down from shoulder | 99.2% | 15.125 | 100.8% | 101.6% | 102.5% |
| g | Cross Shoulder (Top of Shoulder) | 99.2% | 16.625 | 100.8% | 101.5% | 102.2% |
| h | Cross Back 4" down from shoulder | 99.2% | 15.875 | 100.8% | 101.6% | 102.3% |
| i | Armhole Opening | 99.4% | 19.875 | 100.6% | 101.9% | 103.1% |
| j | Sleeve Length (from Center Back) | 100.0% | 32.375 | 100.0% | 100.0% | 100.0% |
| k | Armhole Bottom to Waist | 100.0% | 7.000 | 100.0% | 100.0% | 100.0% |
| l | Cuff Opening | 100.0% | 9.625 | 100.0% | 100.0% | 100.0% |
| m | Cuff Width | 100.0% | 3.000 | 100.0% | 100.0% | 100.0% |
| n | Sleeve Placket Length | 100.0% | 5.000 | 100.0% | 100.0% | 100.0% |
| o | Sleeve Placket Width | 100.0% | 0.875 | 100.0% | 100.0% | 100.0% |
| p | Back Neck Width | 100.0% | 6.875 | 100.0% | 100.0% | 100.0% |
| q | Front Neck Drop | 100.0% | 1.625 | 100.0% | 100.0% | 100.0% |
| r | Back Neck Drop | 100.0% | 0.500 | 100.0% | 100.0% | 100.0% |
| s | Collar Band Width at Center Back | 100.0% | 1.125 | 100.0% | 100.0% | 100.0% |
| t | Collar Width | 100.0% | 3.000 | 100.0% | 100.0% | 100.0% |
| u | Collar Spread | 100.0% | 3.250 | 100.0% | 100.0% | 100.0% |
| v | Center Front Placket Width | 100.0% | 1.250 | 100.0% | 100.0% | 100.0% |
| w | Yoke at Center Back | 100.0% | 3.250 | 100.0% | 100.0% | 100.0% |
| x | Sweep | 100.0% | 0.000 | 100.0% | 100.0% | 100.0% |

FIG. 9A

| | | Bra Cup Size | | | | |
|---|---|---|---|---|---|---|
| | | Sophie Hudson Women's Fit 10008 Shirt "Long" Measurements in inches | | | | |
| Variable | Chest Circumference Size 34 Measurements Description | A | B | C | D | DD |
| a | Body Length (from High Point Shoulder) | 99.5% | 26.750 | 100.5% | 101.4% | 102.3% |
| b | High Point Shoulder to Apex | 97.6% | 10.500 | 104.8% | 109.3% | 113.7% |
| c | Chest Width (Front & Back combined) 1" below armhole | 98.2% | 42.500 | 102.9% | 105.8% | 108.0% |
| d | Bottom Width | 98.9% | 46.500 | 101.1% | 102.7% | 104.2% |
| e | Waist 7" below armhole | 98.7% | 39.500 | 101.3% | 103.1% | 105.0% |
| f | Cross Front 4" down from shoulder | 99.2% | 15.125 | 100.8% | 101.6% | 102.5% |
| g | Cross Shoulder (Top of Shoulder) | 99.2% | 16.625 | 100.8% | 101.5% | 102.2% |
| h | Cross Back 4" down from shoulder | 99.2% | 16.375 | 100.8% | 101.5% | 102.3% |
| i | Armhole Opening | 99.4% | 20.375 | 100.6% | 101.8% | 103.0% |
| j | Sleeve Length (from Center Back) | 100.0% | 33.375 | 100.0% | 100.0% | 100.0% |
| k | Armhole Bottom to Waist | 100.0% | 0.000 | 100.0% | 100.0% | 100.0% |
| l | Cuff Opening | 100.0% | 8.625 | 100.0% | 100.0% | 100.0% |
| m | Cuff Width | 100.0% | 3.000 | 100.0% | 100.0% | 100.0% |
| n | Sleeve Placket Length | 100.0% | 4.500 | 100.0% | 100.0% | 100.0% |
| o | Sleeve Placket Width | 100.0% | 0.875 | 100.0% | 100.0% | 100.0% |
| p | Back Neck Width | 100.0% | 6.625 | 100.0% | 100.0% | 100.0% |
| q | Front Neck Drop | 100.0% | 3.625 | 100.0% | 100.0% | 100.0% |
| r | Back Neck Drop | 100.0% | 0.500 | 100.0% | 100.0% | 100.0% |
| s | Collar Band Width at Center Back | 100.0% | 1.125 | 100.0% | 100.0% | 100.0% |
| t | Collar Width | 100.0% | 0.000 | 100.0% | 100.0% | 100.0% |
| u | Collar Spread | 100.0% | 0.000 | 100.0% | 100.0% | 100.0% |
| v | Center Front Placket Width | 100.0% | 1.250 | 100.0% | 100.0% | 100.0% |
| w | Yoke at Center Back | 100.0% | 0.000 | 100.0% | 100.0% | 100.0% |
| x | Sweep | 100.0% | 0.000 | 100.0% | 100.0% | 100.0% |

FIG. 9B

| | | Bra Cup Size | | | | |
|---|---|---|---|---|---|---|
| | | Rebecca & Drew Marie Shirt "Long" Measurements in inches | | | | |
| Variable | Chest Circumference Size 34 Measurements Description | A | B | C | D | DD |
| a | Body Length (from High Point Shoulder) | 100.0% | 22.250 | 100.0% | 100.0% | 100.0% |
| b | High Point Shoulder to Apex | 97.5% | 10.000 | 102.5% | 104.9% | 109.7% |
| c | Chest Width (Front & Back combined) 1" below armhole | 98.0% | 37.000 | 103.4% | 106.6% | 110.4% |
| d | Bottom Width | 98.7% | 38.000 | 101.3% | 102.6% | 104.5% |
| e | Waist 7" below armhole | 98.3% | 29.500 | 101.7% | 103.4% | 105.8% |
| f | Cross Front 4" down from shoulder | 100.0% | 0.000 | 100.0% | 100.0% | 100.0% |
| g | Cross Shoulder (Top of Shoulder) | 100.0% | 15.000 | 100.0% | 100.0% | 100.0% |
| h | Cross Back 4" down from shoulder | 100.0% | 14.000 | 100.0% | 100.0% | 100.0% |
| i | Armhole Opening | 99.3% | 19.000 | 100.7% | 101.3% | 102.0% |
| j | Sleeve Length (from Center Back) | 100.0% | 15.500 | 100.0% | 100.0% | 100.0% |
| k | Armhole Bottom to Waist | 100.0% | 7.000 | 100.0% | 100.0% | 100.0% |
| l | Cuff Opening | 100.0% | 0.000 | 100.0% | 100.0% | 100.0% |
| m | Cuff Width | 100.0% | 0.000 | 100.0% | 100.0% | 100.0% |
| n | Sleeve Placket Length | 100.0% | 0.000 | 100.0% | 100.0% | 100.0% |
| o | Sleeve Placket Width | 100.0% | 0.000 | 100.0% | 100.0% | 100.0% |
| p | Back Neck Width | 100.0% | 8.000 | 100.0% | 100.0% | 100.0% |
| q | Front Neck Drop | 98.3% | 7.250 | 101.7% | 103.4% | 105.1% |
| r | Back Neck Drop | 100.0% | 1.000 | 100.0% | 100.0% | 100.0% |
| s | Collar Band Width at Center Back | 100.0% | 0.000 | 100.0% | 100.0% | 100.0% |
| t | Collar Width | 100.0% | 0.000 | 100.0% | 100.0% | 100.0% |
| u | Collar Spread | 100.0% | 0.000 | 100.0% | 100.0% | 100.0% |
| v | Center Front Placket Width | 100.0% | 0.000 | 100.0% | 100.0% | 100.0% |
| w | Yoke at Center Back | 100.0% | 0.000 | 100.0% | 100.0% | 100.0% |
| x | Sweep | 100.0% | 0.000 | 100.0% | 100.0% | 100.0% |

FIG. 9C

| | | Bra Cup Size | | | | |
|---|---|---|---|---|---|---|
| | | Rebecca & Drew Slim Fit Shirt "Long" Measurements in inches | | | | |
| Variable | Chest Circumference Size 34 Measurements Description | A | B | C | D | DD |
| a | Body Length (from High Point Shoulder) | 99.5% | 25.000 | 100.5% | 101.0% | 101.5% |
| b | High Point Shoulder to Apex | 97.5% | 10.000 | 102.5% | 104.9% | 109.7% |
| c | Chest Width (Front & Back combined) 1" below armhole | 97.9% | 36.000 | 103.5% | 106.8% | 110.1% |
| d | Bottom Width | 98.7% | 38.500 | 101.3% | 102.6% | 104.5% |
| e | Waist 7" below armhole | 98.4% | 30.500 | 101.6% | 103.3% | 105.6% |
| f | Cross Front 4" down from shoulder | 99.0% | 12.750 | 101.0% | 102.0% | 102.9% |
| g | Cross Shoulder (Top of Shoulder) | 99.2% | 15.000 | 100.8% | 101.7% | 102.5% |
| h | Cross Back 4" down from shoulder | 99.1% | 13.750 | 100.9% | 101.8% | 102.7% |
| i | Armhole Opening | 99.3% | 19.000 | 100.7% | 101.3% | 102.0% |
| j | Sleeve Length (from Center Back) | 100.0% | 32.000 | 100.0% | 100.0% | 100.0% |
| k | Armhole Bottom to Waist | 100.0% | 7.000 | 100.0% | 100.0% | 100.0% |
| l | Cuff Opening | 100.0% | 8.000 | 100.0% | 100.0% | 100.0% |
| m | Cuff Width | 100.0% | 3.000 | 100.0% | 100.0% | 100.0% |
| n | Sleeve Placket Length | 100.0% | 4.000 | 100.0% | 100.0% | 100.0% |
| o | Sleeve Placket Width | 100.0% | 0.875 | 100.0% | 100.0% | 100.0% |
| p | Back Neck Width | 100.0% | 6.250 | 100.0% | 100.0% | 100.0% |
| q | Front Neck Drop | 100.0% | 2.000 | 100.0% | 100.0% | 100.0% |
| r | Back Neck Drop | 100.0% | 0.500 | 100.0% | 100.0% | 100.0% |
| s | Collar Band Width at Center Back | 100.0% | 1.250 | 100.0% | 100.0% | 100.0% |
| t | Collar Width | 100.0% | 3.000 | 100.0% | 100.0% | 100.0% |
| u | Collar Spread | 100.0% | 3.250 | 100.0% | 100.0% | 100.0% |
| v | Center Front Placket Width | 100.0% | 1.250 | 100.0% | 100.0% | 100.0% |
| w | Yoke at Center Back | 100.0% | 3.000 | 100.0% | 100.0% | 100.0% |
| x | Sweep | 100.0% | 0.000 | 100.0% | 100.0% | 100.0% |

FIG. 9D

| | | Bra Cup Size | | | | |
|---|---|---|---|---|---|---|
| | | Rebecca & Drew Relaxed Fit Shirt "Long" Measurements in inches | | | | |
| Variable | Chest Circumference Size 34 Measurements Description | A | B | C | D | DD |
| a | Body Length (from High Point Shoulder) | 99.5% | 25.000 | 100.5% | 101.0% | 101.5% |
| b | High Point Shoulder to Apex | 97.5% | 10.000 | 103.8% | 107.4% | 112.0% |
| c | Chest Width (Front & Back combined) 1" below armhole | 98.1% | 38.500 | 103.2% | 106.4% | 109.4% |
| d | Bottom Width | 98.8% | 43.000 | 101.2% | 102.3% | 104.0% |
| e | Waist 7" below armhole | 98.7% | 37.500 | 101.3% | 102.6% | 104.6% |
| f | Cross Front 4" down from shoulder | 99.0% | 12.750 | 101.0% | 102.0% | 102.9% |
| g | Cross Shoulder (Top of Shoulder) | 99.2% | 15.000 | 100.8% | 101.7% | 102.5% |
| h | Cross Back 4" down from shoulder | 99.1% | 13.750 | 100.9% | 101.8% | 102.7% |
| i | Armhole Opening | 99.3% | 19.000 | 100.7% | 101.3% | 102.0% |
| j | Sleeve Length (from Center Back) | 100.0% | 32.000 | 100.0% | 100.0% | 100.0% |
| k | Armhole Bottom to Waist | 100.0% | 7.000 | 100.0% | 100.0% | 100.0% |
| l | Cuff Opening | 100.0% | 8.125 | 100.0% | 100.0% | 100.0% |
| m | Cuff Width | 100.0% | 3.000 | 100.0% | 100.0% | 100.0% |
| n | Sleeve Placket Length | 100.0% | 4.000 | 100.0% | 100.0% | 100.0% |
| o | Sleeve Placket Width | 100.0% | 0.875 | 100.0% | 100.0% | 100.0% |
| p | Back Neck Width | 100.0% | 6.375 | 100.0% | 100.0% | 100.0% |
| q | Front Neck Drop | 100.0% | 2.125 | 100.0% | 100.0% | 100.0% |
| r | Back Neck Drop | 100.0% | 0.500 | 100.0% | 100.0% | 100.0% |
| s | Collar Band Width at Center Back | 100.0% | 1.250 | 100.0% | 100.0% | 100.0% |
| t | Collar Width | 100.0% | 3.000 | 100.0% | 100.0% | 100.0% |
| u | Collar Spread | 100.0% | 3.250 | 100.0% | 100.0% | 100.0% |
| v | Center Front Placket Width | 100.0% | 1.250 | 100.0% | 100.0% | 100.0% |
| w | Yoke at Center Back | 100.0% | 3.000 | 100.0% | 100.0% | 100.0% |
| x | Sweep | 100.0% | 0.000 | 100.0% | 100.0% | 100.0% |

FIG. 9E b = High Point Shoulder to Apex f = Cross Front

200

| | | Bra Cup Size | | | | |
|---|---|---|---|---|---|---|
| | | Slim Fit Shirt-Dress "Long" Measurements in inches | | | | |
| Variable | Chest Circumference Size 34 Measurements Description | A | B | C | D | DD |
| a | Body Length (from High Point Shoulder) | 38.625 | 38.750 | 38.875 | 39.000 | 39.125 |
| b | High Point Shoulder to Apex | 9.750 | 10.000 | 10.250 | 10.500 | 11.000 |
| c | Chest Width (Front & Back combined) 1" below armhole | 34.250 | 35.000 | 36.250 | 37.500 | 38.750 |
| d | Bottom Width | 38.500 | 39.000 | 39.500 | 40.000 | 40.750 |
| e | Waist 7" below armhole | 30.000 | 30.500 | 31.000 | 31.500 | 32.250 |
| f | Cross Front 4" down from shoulder | 11.750 | 11.875 | 12.000 | 12.125 | 12.250 |
| g | Cross Shoulder (Top of Shoulder) | 14.500 | 14.625 | 14.750 | 14.875 | 15.000 |
| h | Cross Back 4" down from shoulder | 13.125 | 13.250 | 13.375 | 13.500 | 13.625 |
| i | Armhole Opening | 18.375 | 18.500 | 18.625 | 18.750 | 18.875 |
| j | Sleeve Length (from Center Back) | 21.000 | 21.000 | 21.000 | 21.000 | 21.000 |
| k | Armhole Bottom to Waist | 7.000 | 7.000 | 7.000 | 7.000 | 7.000 |
| l | Cuff Opening | 10.500 | 10.500 | 10.500 | 10.500 | 10.500 |
| m | Cuff Width | 3.000 | 3.000 | 3.000 | 3.000 | 3.000 |
| n | Sleeve Placket Length | 3.500 | 3.500 | 3.500 | 3.500 | 3.500 |
| o | Sleeve Placket Width | 0.875 | 0.875 | 0.875 | 0.875 | 0.875 |
| p | Back Neck Width | 6.250 | 6.250 | 6.250 | 6.250 | 6.250 |
| q | Front Neck Drop | 2.000 | 2.000 | 2.000 | 2.000 | 2.000 |
| r | Back Neck Drop | 0.500 | 0.500 | 0.500 | 0.500 | 0.500 |
| s | Collar Band Width at Center Back | 1.500 | 1.500 | 1.500 | 1.500 | 1.500 |
| t | Collar Width | 3.000 | 3.000 | 3.000 | 3.000 | 3.000 |
| u | Collar Spread | 3.250 | 3.250 | 3.250 | 3.250 | 3.250 |
| v | Center Front Placket Width | 1.250 | 1.250 | 1.250 | 1.250 | 1.250 |
| w | Yoke at Center Back | 2.875 | 2.875 | 2.875 | 2.875 | 2.875 |
| x | Sweep | 44.000 | 44.500 | 45.000 | 45.500 | 46.250 |

FIG. 21C

METHODS FOR OPTIMALLY ADJUSTING MEASUREMENTS OF GARMENTS

CROSS REFERENCE TO RELATED APPLICATION

This claims the benefit of U.S. Provisional Patent Application No. 60/689,191, filed Jun. 10, 2005, which is incorporated herein by reference in its entirety.

BACKGROUND OF THE INVENTION

The disclosed invention relates to the art of design and manufacture of garments and apparel generally and, more particularly, to methods for optimally adjusting measurements of outer garments.

Prior to the present invention, garments were generally made using one of a number of methods. The first method was to custom-make each garment to fit a particular individual, also referred to herein as a "wearer". This method was very tedious, labor-intensive and expensive. The second approach was to make garments that were sized generically, so that a garment of a particular size was wearable by many individuals for whom the garment was substantially suitable. The measurements of these garments were very generic and based upon grossly simplified body shapes; they were often dictated, as well, by what fabric was available, the general mores of the times, and other factors, but, except for some gross dimensions, such as height and girth, had very little to do with the actual measurements of a particular wearer. Accordingly, these garments were either too loose or too tight, too long or too short and ultimately did not fit individuals especially well.

During the last century, a third method was developed. As part of this method, garments are made from one pattern, and all sizes are graded (increased or decreased proportionally) from that one pattern. Garments made by this process are sized using numbers and size-related terminology. For example, women's blouses are frequently available in sizes 0, 2, 4, 6, 8, etc., or sizes petite, small, regular, large, etc. These sizes relate to a grading system wherein a master pattern with a standard fit is created for a garment and then measurements for the other sizes are obtained by increasing or decreasing the master pattern by a proportional rate.

Typically, a line of garments is developed by a designer as follows: First, the designer creates a master pattern for a particular target customer, in a particular "sample size", such as size 4. Then, all other sizes are usually generated by either increasing or decreasing the measurements of the master pattern proportionally. For example, selected measurements for a size 6 are generated by increasing the measurements of the size 4 master pattern proportionally, while selected measurements for a size 2 are generated by decreasing the measurements of the size 4 master pattern proportionally.

This system is still in use today and allows garment designers and manufacturers to make so-called "off-the-rack" garments that are mass-produced, but may not be appropriate to an individual's measurements.

A major problem with this existing system is that there are no standard formulas for increasing or decreasing the measurements of one parameter of a pattern, while keeping the remaining measurements unchanged, all to enhance a garment's fit in a particular way. For example, when a designer makes a master pattern of a particular size, such as size 4, those measurements are fixed, and there is currently no known means for changing those measurements to compensate for variations in a particular body region, such as the chest area, among wearers who are otherwise a size 4. So, for example, because the overall measurements of a garment are graded proportionally to get to another size, such as a size 2 or 6 (under the old system), there are no standard means for adjusting a pattern to fit a small-busted individual with a certain set of body measurements, as opposed to a large-busted individual whose body measurements are otherwise similar to the small-busted individual. Thus, no recognition has been given in the prior art to the need for certain areas or parts of a garment to grow or to shrink independently of all other areas, as opposed to other sizing methods that may fit the bust or the waist, but not both simultaneously. Instead, in this prior art scenario, when a pattern is graded from one size to the next, the pattern's measurements increase or decrease proportionally.

Therefore, the existing approach does not result in satisfactory garments because it ignores some physical characteristics of the wearers. For example, for a tall wearer, more material is simply added to the bottom hem of a shirt, instead of at various points on the garment so as to lengthen it proportionally or otherwise. Additionally, such garments lack any sizing continuity between designers, and often within the same designer's lines from one season to the next. Because such garment measurements are not based on any industry-accepted "standard", there is no compelling precedent to follow, and therefore one designer's size 4 may or may not be the same as the next designer's.

It is therefore desirable to provide methods and a set of standard algorithms that may allow measurements of garments to be adjusted optimally and properly and thereby may allow the garments to fit reliably.

SUMMARY OF THE INVENTION

In accordance with the principles of the present invention, methods for optimally adjusting measurements of garments are provided. For illustrative purposes, a method is described for making a garment, such as a shirt, it being understood that the method can easily be extended to other garments as well.

The invention may further provide measurement adjustments that begin with the representative 'body type' of the target customer, such as a shape target (athletic shape, big boned shape etc.), ethnic target or age target (adolescent, middle age, elderly etc.). Then the fashion style is considered, such as "Slim Fit" or "Relaxed Fit" etc. Then according to this invention, a garment line may be made using a number of base patterns (such as one pattern for each bra cup size) instead of one. This may provide the ability to increase or to decrease certain measurements at different rates, thereby resulting in a better fit by accounting for other considerations and parameters.

Although one fashion style is that of a close-to-the-body fit, such as a Slim Fit style, the invention is not limited to this particular trend. For instance, a brassiere (bra) measurement, also referred to as "bust measurement" or "chest measurement", which includes a chest circumference and a bra cup size, can be incorporated into a tailored garment as well as into a loose-fitting garment, such as a Relaxed Fit style, thus enhancing the versatility of a garment sized pursuant to this invention. The invention can also be used for different body types within one fashion style so that a tailored garment designed for a woman with an athletic build would be different than the equivalent tailored garment for an elderly demographic. Thus, in one embodiment of the invention, a garment may be made using an algorithm to fit various body types, including athletic body, small boned body, elderly body, etc., in various styles, including Slim and Relaxed Fit, etc. Moreover, the sizing algorithm can be extended to make fractional sized garments (e.g., 34½, B+, B−, etc.) and also various articles of clothing, such as woven tops, cut-and-sew knit tops, fully-fashioned knit tops, jackets, coats, dresses and outerwear, including but not limited to shirts, shirt-dresses and blazers. As a result, using the disclosed sizing algorithm, garments may be created by choosing a style and body type, and they may fit the various shapes and sizes of different body measurements. The invention may be particularly suited for making off-the-rack clothing, based on the individual, and appropriate to the brand, that has the special and individualized advantages described hereinabove.

Thus, a garment made with this invention's method may incorporate the bra measurements of an individual into the garment, independently of other measurements. Other garment measurements, such as cuff opening and width, sleeve placket length and width, and back neck width and drop, may remain standard, while the bra measurement may be incorporated independently. While the garment's cross-front measurement may increase or decrease due to an individual's unique shape and dimensions, the other garment measurements may grade in a standard manner from one size to another.

Stated generally, the present invention may be used to create garments that fit based on a particular body measurement. In one embodiment of the invention, a novel algorithm may be used to determine various measurements of a garment in one size from the measurements of the garment in another size, depending on a particular body measurement. For example, a master pattern may be designed in the usual manner for a garment of a specific size. The master pattern may be defined by a plurality of measurements, divided into two groups, covering different garment characteristics. One group of measurements may be adjusted up or down to arrive at various fits using a nonproportional adjusting system unique to this invention. For example, those measurements may be adjusted based on bra cup size. A second group of measurements may remain unchanged even with changing bra cup size. To obtain measurements for the same bra cup size but different chest circumference, the measurements may be graded up or down proportionally, using standard criteria as may be known to those in the art.

While most of a garment's measurements belong in the second group mentioned above, the present inventors have identified specific measurements that can be changed to compensate for the specific characteristics of some wearers' bodies. Thus, the inventive method herein yields garments that may fit variously-sized wearers much better than when previous methods are used. As has been noted, the primary measurements that may be used in the present invention are bra measurement and height. Garments made in accordance with this invention may then be adjusted based on the bra measurement and height to conform more particularly to an individual's personal measurements. For example, shirts can be made in the same sizes as bras, e.g. 32A-DD, 34A-DD, 36A-DD, or any sizes in between or larger or smaller than standard-sized bras. Moreover, the garments may be classified for height as well, whereby garments may be characterized as petite, regular, long, extra long, short, etc. A shirt that is characterized as long may add that length in three key areas that affect the overall fit of the shirt. For example, the measurements for body length, high point shoulder to apex and sleeve length may increase in a shirt that is characterized as long.

BRIEF DESCRIPTION OF THE DRAWINGS

The above and other advantages of the invention will be apparent upon consideration of the following detailed description, taken in conjunction with the accompanying drawings, in which like reference characters refer to like parts throughout, and in which:

FIG. 1C is a table defining the measurements for a garment pattern in accordance with one embodiment of the present invention;

FIG. 6 is a table showing measurements (a-x) of five Slim Fit Shirt "Long" patterns, sold by Rebecca & Drew Manufacturing, LLC, New York, New York, with a size 34 chest circumference and bra cup sizes ranging from A to DD, in accordance with one embodiment of the present invention;

FIG. 7A is a table showing measurements (a-x) of Slim Fit Shirt "Petite" patterns with sizes 30-40 chest circumference and bra cup size A, in accordance with one embodiment of the present invention;

FIG. 7B is a table showing measurements (a-x) of Slim Fit Shirt "Petite" patterns with sizes 30-40 chest circumference and bra cup size B, in accordance with one embodiment of the present invention;

FIG. 7C is a table showing measurements (a-x) of Slim Fit Shirt "Petite" patterns with sizes 30-40 chest circumference and bra cup size C, in accordance with one embodiment of the present invention;

FIG. 7D is a table showing measurements (a-x) of Slim Fit Shirt "Petite" patterns with sizes 30-40 chest circumference and bra cup size D, in accordance with one embodiment of the present invention;

FIG. 7E is a table showing measurements (a-x) of Slim Fit Shirt "Petite" patterns with sizes 30-40 chest circumference and bra cup size DD, in accordance with one embodiment of the present invention;

FIG. 8A is a table showing the percentage by which each measurement (a-x) of a Slim Fit Shirt pattern size 34B long may be changed to obtain Slim Fit Shirt patterns of size 34A long, 34C long, 34D long and 34DD long, in accordance with one embodiment of the present invention;

FIG. 8B is a table showing the percentage by which each measurement (a-x) of a Relaxed Fit Shirt pattern, sold by Rebecca & Drew Manufacturing, LLC, New York, N.Y., size 34B long may be changed to obtain Relaxed Fit Shirt patterns of size 34A long, 34C long, 34D long and 34DD long, in accordance with one embodiment of the present invention;

FIG. 8C is a table showing the percentage by which each measurement (a-x) of a Halter Shirt pattern, sold by Rebecca & Drew Manufacturing, LLC, New York, N.Y., size 34B long may be changed to obtain Halter Shirt patterns of size 34A long, 34C long, 34D long and 34DD long, in accordance with one embodiment of the present invention;

FIG. 8D is a table showing, for a style of the "Missy Fit" type, sold by Sophie Hudson, Inc., New York, N.Y., as "Sophie Hudson Missy Fit 10007" Shirt, the percentage by which each measurement (a-x) of a "Sophie Hudson Missy Fit 10007" Shirt pattern size 34B long may be changed to obtain "Sophie Hudson Missy Fit 10007" Shirt patterns of size 34A long, 34C long, 34D long and 34DD long, in accordance with one embodiment of the present invention;

FIG. 8E is a table showing, for a style of the "Missy Fit" type, sold by Sophie Hudson, Inc., New York, N.Y., as "Sophie Hudson Missy Fit 10008" Shirt, the percentage by which each measurement (a-x) of a "Sophie Hudson Missy Fit 10008" Shirt pattern size 34B long may be changed to obtain "Sophie Hudson Missy Fit 10008" Shirt patterns of size 34A long, 34C long, 34D long and 34DD long, in accordance with one embodiment of the present invention;

FIG. 9A is a table showing, for a style of the "Women's Fit" type, sold by Sophie Hudson, Inc., New York, N.Y., as "Sophie Hudson Women's Fit 10007" Shirt, the finished measurements (a-x) of each size 34A-DD long "Sophie Hudson Women's Fit 10007" Shirt pattern being expressed as a percentage of the finished measurements of the master pattern of size 34B long, in accordance with one embodiment of the present invention;

FIG. 9B is a table showing, for a style of the "Women's Fit" type, sold by Sophie Hudson, Inc., New York, N.Y., as "Sophie Hudson Women's Fit 10008" Shirt, the finished measurements (a-x) of each size 34A-DD long "Sophie Hudson Women's Fit 10008" Shirt pattern being expressed as a percentage of the finished measurements of the master pattern of size 34B long, in accordance with one embodiment of the present invention;

FIG. 9C is a table showing the finished measurements (a-x) of each size 34A-DD long "Marie" Shirt pattern, sold by Rebecca & Drew Manufacturing, LLC, New York, N.Y., being expressed as a percentage of the finished measurements of the master pattern of size 34B long, in accordance with one embodiment of the present invention;

FIG. 9D is a table showing the finished measurements (a-x) of each size 34A-DD long Slim Fit Shirt pattern being expressed as a percentage of the finished measurements of the master pattern of size 34B long, in accordance with one embodiment of the present invention;

FIG. 9E is a table showing the finished measurements (a-x) of each size 34A-DD long Relaxed Fit Shirt pattern being expressed as a percentage of the finished measurements of the master pattern of size 34B long, in accordance with one embodiment of the present invention;

FIG. 21C is a table defining the measurements for the Slim Fit Shirt-Dress pattern of FIGS. 21A and 21B, in sizes 34A-DD long, in accordance with one embodiment of the present invention.

DETAILED DESCRIPTION OF THE INVENTION

Figure 1A:
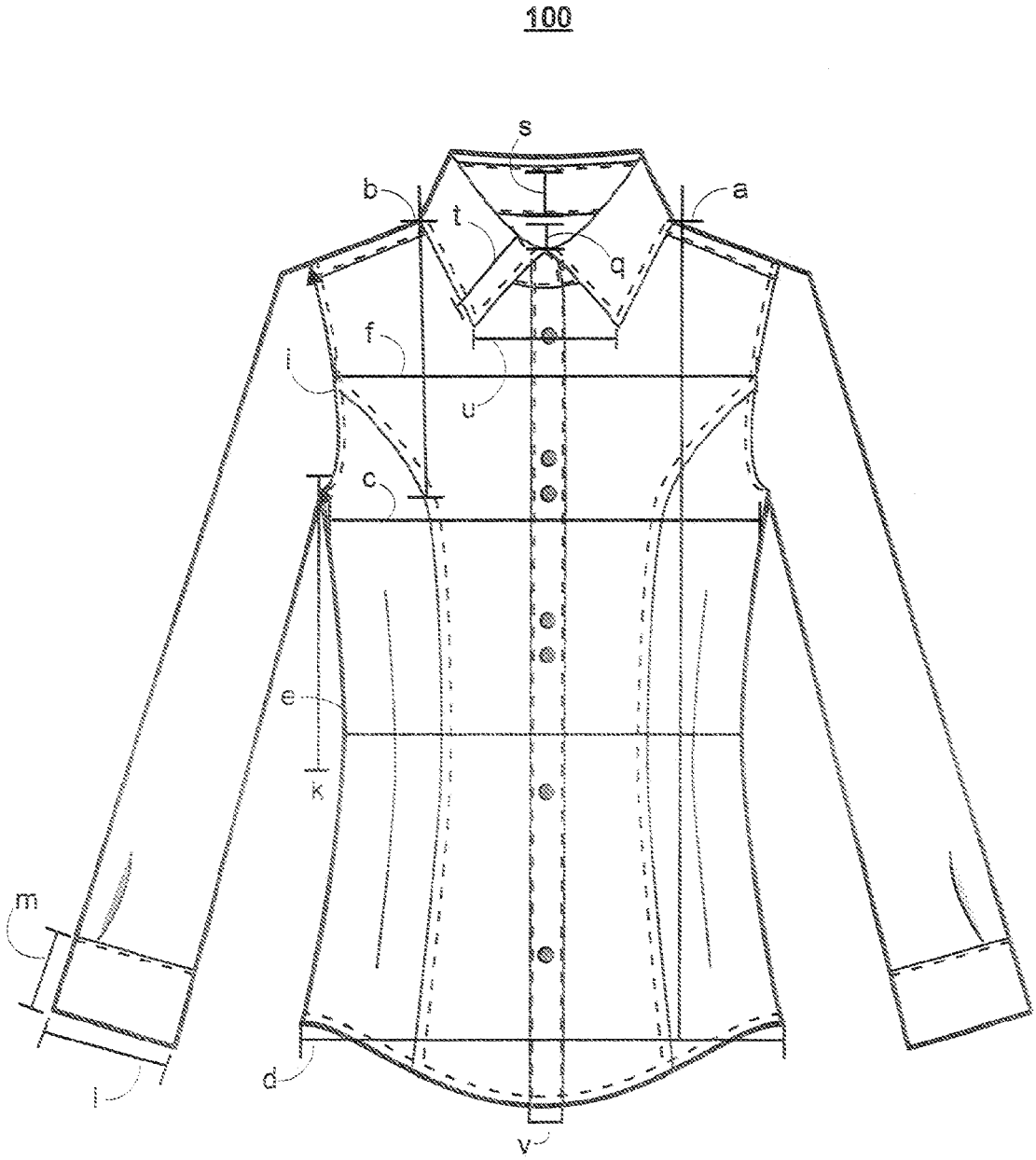
FIG. 1A shows a frontal view of a shirt, indicating how measurements may be defined in accordance with one embodiment of the present invention.

As described above, the present invention improves the way that garments may fit variously-sized and variously-shaped wearers, by allowing some measurements to be adjusted based on a certain physical characteristic of a wearer, and by allowing some measurements to remain the same even if a certain physical characteristic of a wearer changes. This is achieved by designing a garment for a particular body type (such as slim build, athletic build etc.), in a particular style (such as Slim Fit or Relaxed Fit etc.) and in a certain size, and by adjusting some measurements of the garment to obtain the garment in a different size but for the same body type and in the same style. The measurements provide for a degree of conformance to the wearer's body, depending on the wearer's body type and the style of the garment.

A preferred embodiment of the present invention can be used to obtain different sizes of a garment depending on bra measurement, which includes a chest circumference and a bra cup size, and height, thereby yielding garments that may fit much better than when prior art methods are used. In addition to shirts that may be sized based on bra measurement and height, the method according to the present invention may be used to obtain different sizes of other garments, e.g., woven tops, cut-and-sew knit tops, fully-fashioned knit tops, jackets, dresses and outerwear, including but not limited to shirt-dresses, gowns, t-shirts, polo shirts, sweaters, sweatshirts and tank tops.

In one preferred embodiment of the present invention, the sizes for a line of shirts may be defined in terms of three parameters: (1) a chest circumference; (2) a bra cup size; and (3) a length (such as short, regular, long, etc.). Thus, an individual may specify and purchase a shirt that is a "34B long". The first two parameters make up what is referred to herein as the individual's bra measurement, while the third parameter is related to the individuals' height.

One preferred embodiment of the present invention provides an algorithm for obtaining measurements of shirts of different bra cup sizes from a shirt of bra measurement 34B long. A line of shirts made in accordance with this invention can generally be described as follows: First, a master shirt pattern for the chosen body type and shirt style may have one or more of measurements a-x, where a-x may represent body length, high point shoulder to apex point of the breast, chest width, bottom width, waist, cross front, cross shoulder, cross back, armhole opening, sleeve length, armhole bottom to waist, cuff opening, cuff width, sleeve placket length, sleeve placket width, back neck width, front neck drop, back neck drop, collar band width, collar width, collar spread, center front placket width, yoke and sweep, respectively, as listed in FIG. 1C, described in more detail below. A master shirt pattern may be designed for a particular base size, such as 34B long, with one or more of measurements $a=a_0$, $b=b_0$, $c=c_0$, $d=d_0$, $e=e_0$, $f=f_0$, $g=g_0$, $h=h_0$, $i=i_0$, $j=j_0$, $k=k_0$, $l=l_0$, $m=m_0$, $n=n_0$, $o=o_0$, $p=p_0$, $q=q_0$, $r=r_0$, $s=s_0$, $t=t_0$, $u=u_0$, $v=v_0$, $w=w_0$ and $x=x_0$. The measurements of this master shirt pattern may be used to make several other patterns for different bra cup sizes and for different lengths, e.g., 34A regular, 34B regular, 34C regular, 34D regular, 34DD regular, 34F regular, 34G regular, 34A long, 34C long, etc., using the innovative algorithm, which will be illustrated in some specific examples below, expressed as follows:

IF $a=(a_0*Q)+K$, $b=(b_0*R)+L$, $c=c_0*S$, $d=d_0*T$, $e=e_0*U$, $f=f_0*V$, $g=g_0*W$, $h=h_0*X$, $i=i_0*Y$, $j=j_0+M$, $k=k_0+N$, $l=l_0$, $m=m_0$, $n=n_0$, $o=o_0$, $p=p_0$, $q=q_0$, $r=r_0$, $s=s_0$, $t=t_0$, $u=u_0$, $v=v_0$, $w=w_0$ and $x=x_0*Z$

AND BRA CUP SIZE=A,

THEN Q=99.7%, R=97.5%, S=97.9%, T=98.7%, U=98.4%, V=98.9%, W=99.1%, X=99.1%, Y=99.3%, Z=98.9%;

ELSE IF BRA CUP SIZE=C,

THEN Q=100.3%, R=102.5%, S=103.6%, T=101.3%, U=101.6%, V=101.1%, W=100.9%, X=100.9%, Y=100.7%, Z=101.1%;

ELSE IF BRA CUP SIZE=D,

THEN Q=100.6%, R=104.9%, S=107%, T=102.5%, U=103.3%, V=102.1%, W=101.7%, X=101.9%, Y=101.3%, Z=102.2%;

ELSE IF BRA CUP SIZE=DD,

THEN Q=101%, R=109.7%, S=110.4%, T=104.4%, U=105.6%, V=103.1%, W=102.5%, X=102.8%, Y=102%, Z=103.9%;

ELSE IF BRA CUP SIZE=F,

THEN Q=103.2%, R=115.7%, S=111.3%, T=105.8%, U=106.8%, V=103.3%, W=103%, X=103%, Y=104.2%, Z=105%;

ELSE IF BRA CUP SIZE=G,

THEN Q=104.1%, R=117.8%, S=111.5%, T=107.3%, U=108.6%, V=104.1%, W=103.7%, X=103.8%, Y=105.4%, Z=106.1%;

ELSE IF BRA CUP SIZE=B,

THEN Q=R=S=T=U=V=W=X=Y=Z=100%;

WHERE IF HEIGHT<5'2",

THEN K=−3.5", L=−0.875", M=−3.5", N=−1.75";

ELSE IF 5'2"≦HEIGHT<5'6",

THEN K=−2", L=−0.5", M=−2', N=−1";

ELSE IF HEIGHT≧5'11",

THEN K=2", L=0.5", M=2", N=1";

ELSE IF 5'6"≦HEIGHT<5'11",

THEN K=L=M=N=0;

AND ANY ONE OR MORE OF a-x MAY VARY +/−2%.

Thus, to obtain measurement a for a shirt size 34A long, measurement a for a shirt size 34B long ($a_0$) may be decreased by 100-99.7=0.3%; to obtain measurement b for a shirt size 34A long, measurement b for a shirt size 34B long ($b_0$) may be decreased by 100−97.5=2.5%, etc. To obtain measurement j for a shirt size 34C for a wearer of height <5'2", measurement j for a shirt size 34B long ($j_0$) may be decreased by 3.5"; to obtain measurement k for a shirt size 34D for a wearer of height=5'11", measurement k for a shirt size 34B long ($k_0$) may be increased by 1", etc. To obtain measurement a for a shirt size 34DD for a wearer of height=5'2", measurement a for a shirt size 34B long ($a_0$) may be increased by 101-100=1% and decreased by 2"; to obtain measurement b for a shirt size 34F for a wearer of height<5'2", measurement b for a shirt size 34B long ($b_0$) may be increased by 115.7-100=15.7% and decreased by 0.875", etc. The foregoing algorithm can advantageously be expanded to include bra cup sizes smaller than A and larger than G, as well as all other bra cup sizes (or fractions thereof), e.g., A+, A−, etc., and also any other intermediate sizes.

Similar patterns may be also made for the same chest circumference and bra cup sizes, but in different lengths. For a long shirt, the length is not just added to the bottom hem of the shirt as in the prior art. Instead, that length may be added to three key areas that affect the overall fit of the shirt.

Thus, for a long shirt, a regular shirt's measurements for body length may increase by 2 inches (+/−½ inch), high point shoulder to apex may increase by ½ inch (+/−¼ inch) and sleeve length may increase by 2 inches (+/−½ inch). This idea can advantageously be expanded to include lengths other than regular and long, such as short, petite, extra long and also any other intermediate lengths.

Figure 1B:
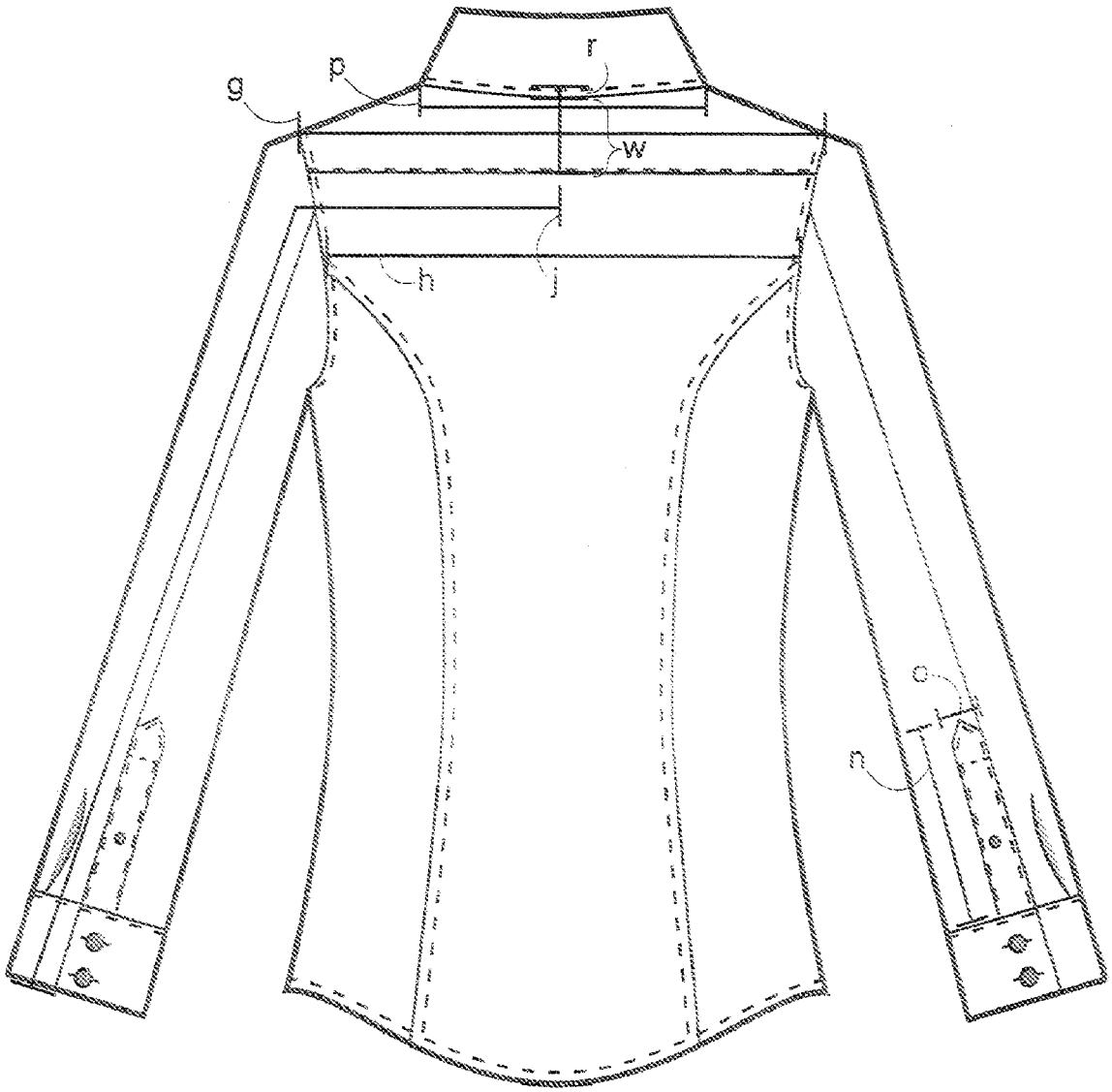
FIG. 1B shows a back view of a shirt, indicating how measurements may be defined in accordance with one embodiment of the present invention.
Figure 10:
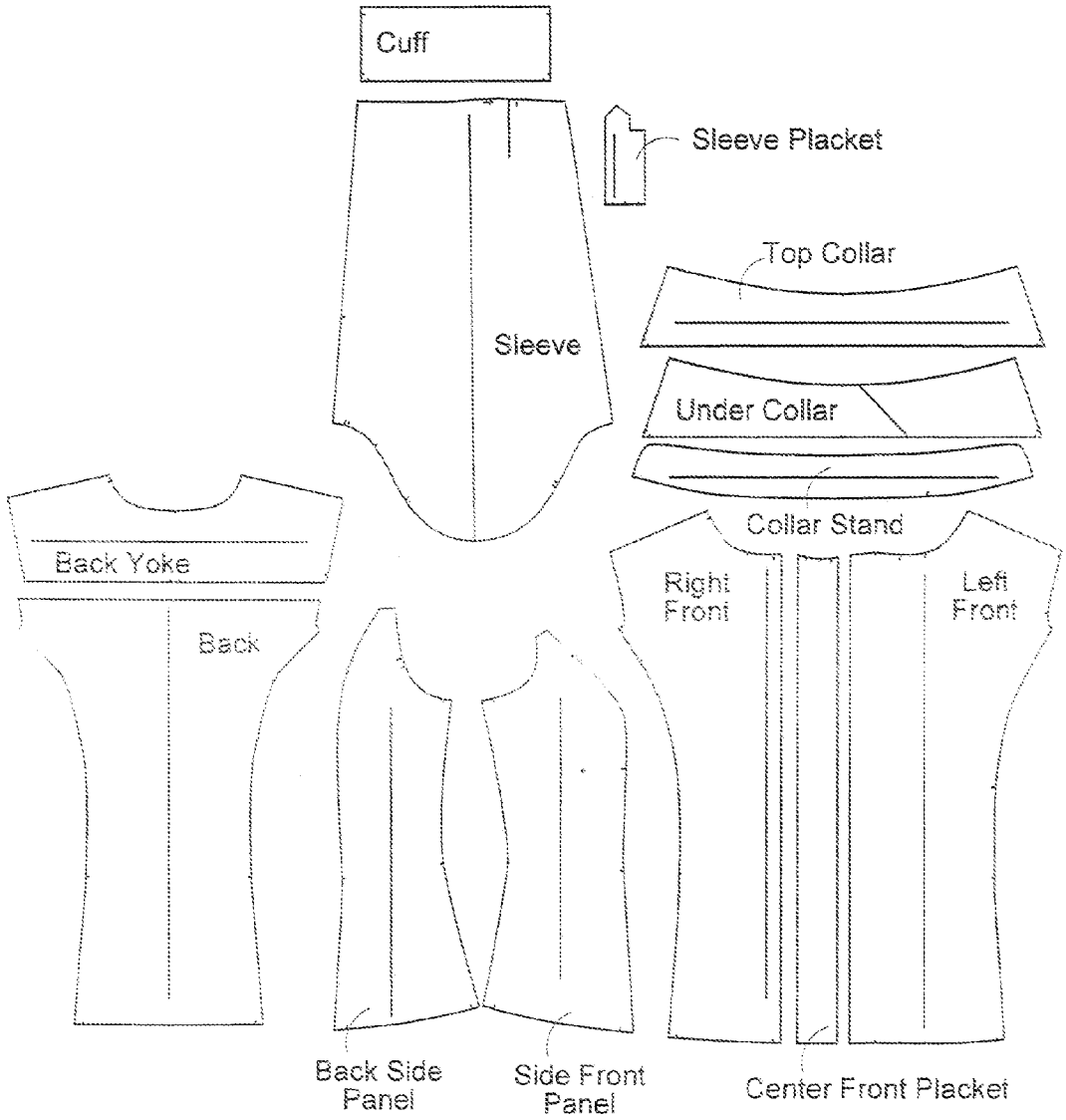
FIG. 10 shows the pattern pieces for a shirt, in accordance with one embodiment of the present invention.

Turning now to FIGS. 1A and 1B, a shirt 100 is shown with standard measurements a-w; FIG. 1C indicates where measurements a-x are taken. For instance, measurement a refers to the length of the body of the shirt from the high point of the shoulder. Knowing these measurements, a person skilled in the art can make a master pattern for shirt 100, using pattern pieces as illustrated in FIG. 10, discussed below in greater detail.

According to this invention, the measurements a-x may be separated into two basic categories. The first category of measurements may include at least the measurements illustrated in FIGS. 2A-C, 3A-C and 4A-C, and may be the measurements that are changed in accordance with this invention, using certain predetermined criteria, but independently of other measurements. The second category of measurements may be illustrated in FIGS. 5A-B, discussed below in greater detail, which are the measurements that are changed conventionally using prior art standards.

Figure 2A:
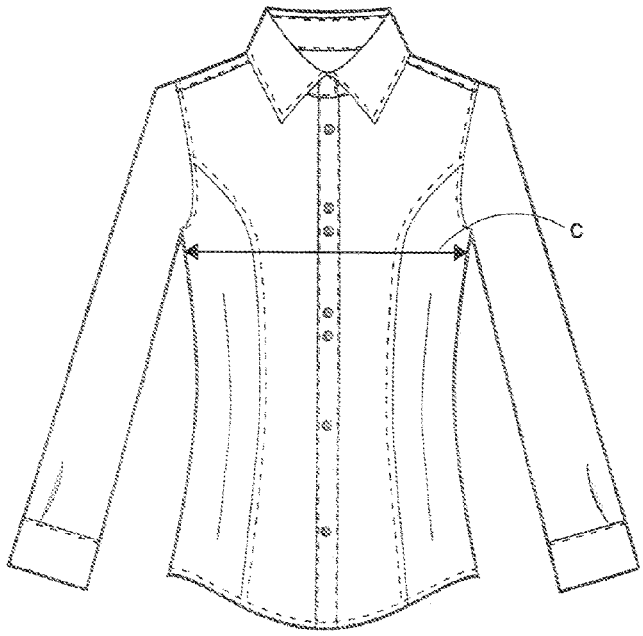
FIG. 2A shows a frontal view of a shirt, constructed in accordance with one embodiment of the present invention by adjusting the chest width of the shirt front to conform to bra measurement.
Figure 2B:
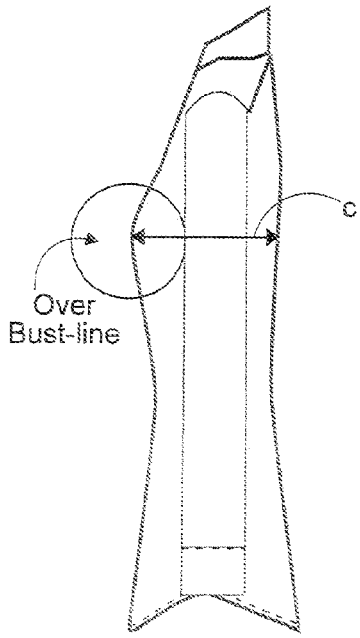
FIG. 2B shows a right-side perspective view of a shirt, constructed in accordance with one embodiment of the present invention by adjusting the chest width of the shirt front to conform to bra measurement.
Figure 2C:
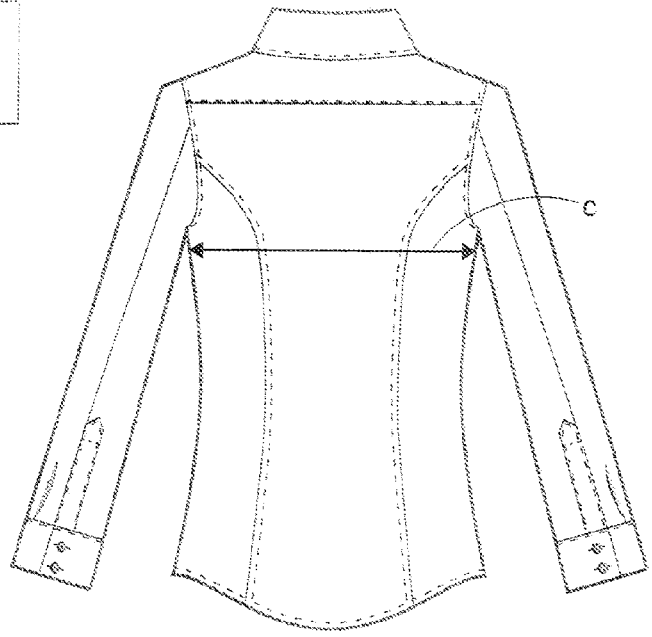
FIG. 2C shows a back view of a shirt, constructed in accordance with one embodiment of the present invention by adjusting the chest width of the shirt front to conform to bra measurement.

FIGS. 2A-C illustrate a first measurement (chest width measurement c) that may be adjusted in accordance with this invention to compensate for changes in the bust line corresponding to changing bra cup sizes. The chest width measurement c extends across the bust and around the back and the sides, as shown. It has been recognized that for better fitting shirts, this measurement should be changed when bra measurement changes, but independently of the other measurements shown in FIGS. 1A-C. For example, in the present invention, for a Slim Fit Shirt pattern size 34B long, the chest width c measures 36 inches, as shown in the table of FIG. 6, discussed below in greater detail. To arrive at a Slim Fit Shirt pattern size 34A long, this measurement may be reduced by 2.1%, as shown in FIG. 8A, discussed below in greater detail; for a Slim Fit Shirt pattern size 34C long, the measurement c may be increased by 3.5%; and for a Slim Fit Shirt pattern size 34D long, c may be increased by 6.9%. In other words, for size 34A long, c may be 35.25 inches; for a 34C long, c may be 37.25 inches; and for a 34D long, c may be 38.5 inches, as shown in the table of FIG. 6, discussed below in greater detail. To ease manufacturing complexities, these values may be rounded off, if necessary.

Figure 3A:
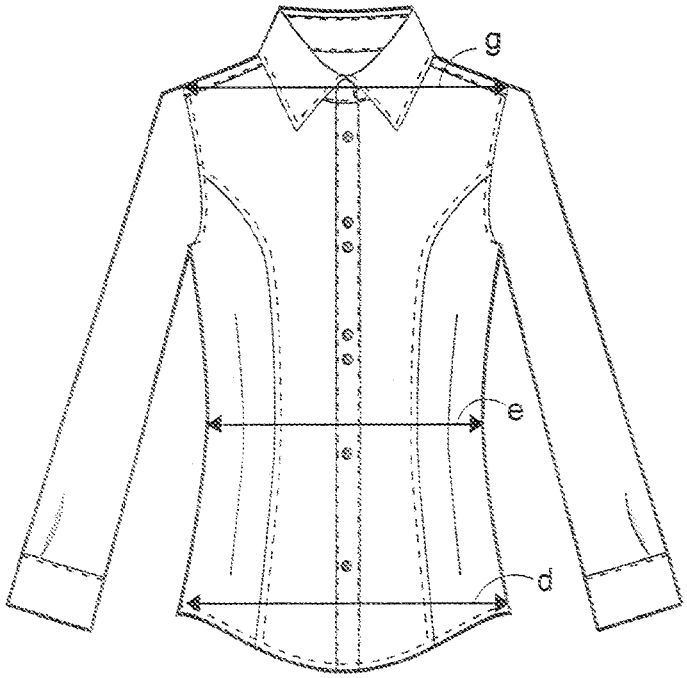
FIG. 3A shows a frontal view of a shirt, constructed in accordance with one embodiment of the present invention by adjusting the bottom width, the cross shoulder and the waist measurements of the shirt to conform to bra measurement.
Figure 3B:
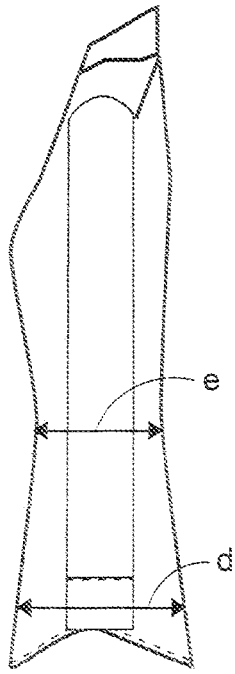
FIG. 3B shows a right-side perspective view of a shirt, constructed in accordance with one embodiment of the present invention by adjusting the bottom width and the waist measurements of the shirt to conform to bra measurement.
Figure 3C:
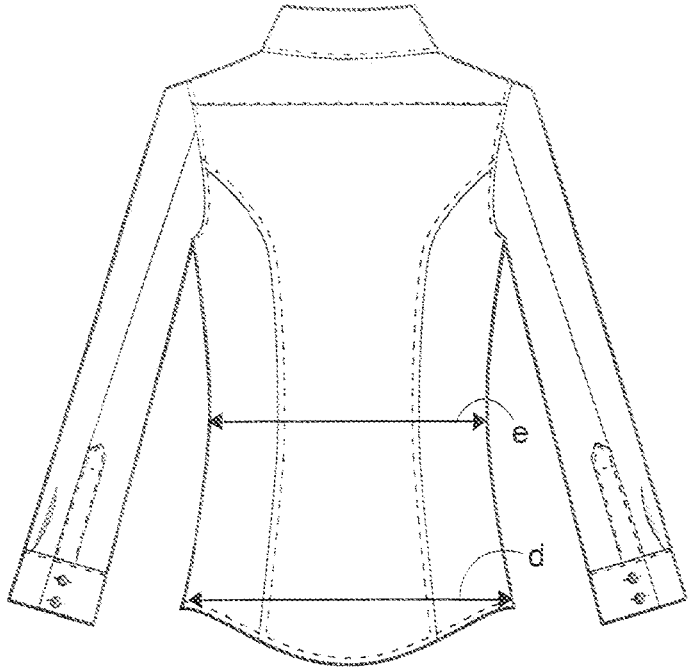
FIG. 3C shows a back view of a shirt, constructed in accordance with one embodiment of the present invention by adjusting the bottom width and the waist measurements of the shirt to conform to bra measurement.

FIGS. 3A-C illustrate how three additional measurements, d, g and e (the bottom width, cross shoulder and waist), may be utilized in this invention. Adjusting these measurements in this manner, independently of the other measurements, may allow for a tailored fit along the waist and hips.

Figure 4A:
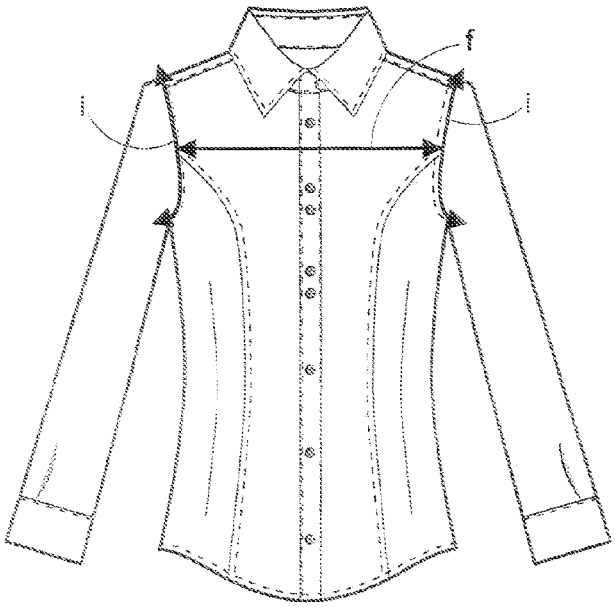
FIG. 4A shows a frontal view of a shirt, constructed in accordance with one embodiment of the present invention by adjusting the cross front and armhole opening measurements of the shirt to conform to bra measurement.
Figure 4B:
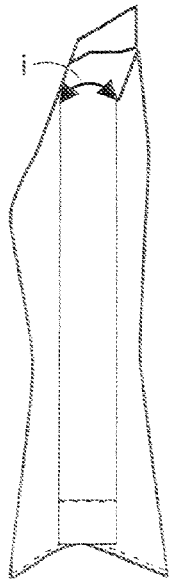
FIG. 4B shows a right-side perspective view of a shirt, constructed in accordance with one embodiment of the present invention by adjusting the armhole opening measurements of the shirt to conform to bra measurement.
Figure 4C:
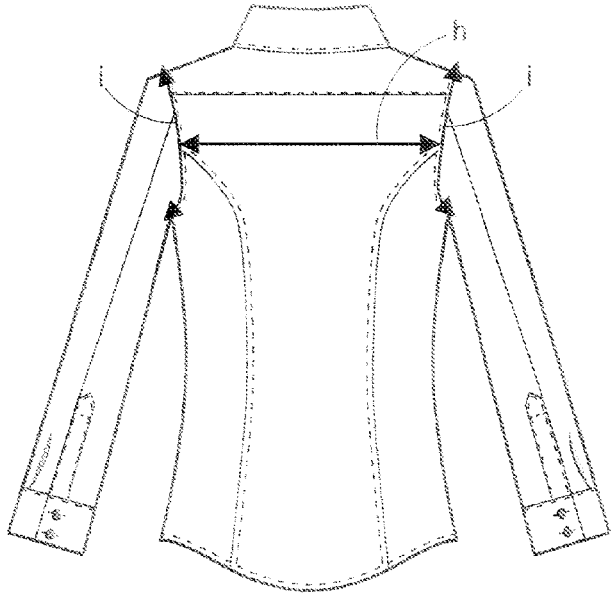
FIG. 4C shows a back view of a shirt, constructed in accordance with one embodiment of the present invention by adjusting the armhole opening and cross back measurements of the shirt to conform to bra measurement.

FIGS. 4A-C illustrate three further measurements, cross front f, cross back h and armhole opening i. All of these measurements may increase or decrease with each bra cup size and chest circumference. Adjusting these measurements in this manner, independently of the other measurements, may allow for an accurate fit above the bust line to prevent bunching and gapping.

Figure 5A:
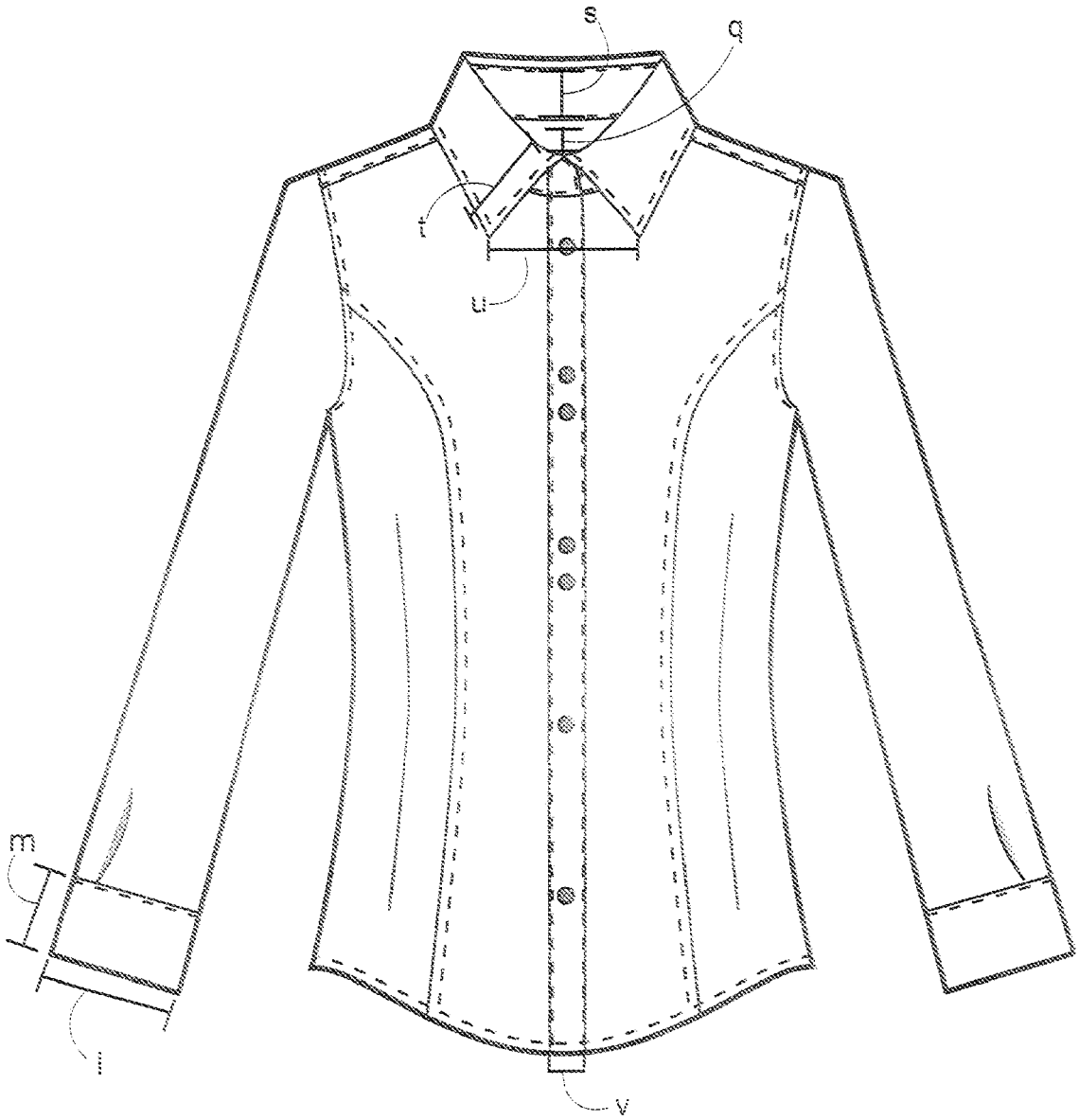
FIG. 5A shows a frontal view of a shirt, constructed in accordance with one embodiment of the present invention with measurements (l, m, q, s, t, u, v) that have been adjusted using standard adjustments.
Figure 5B:
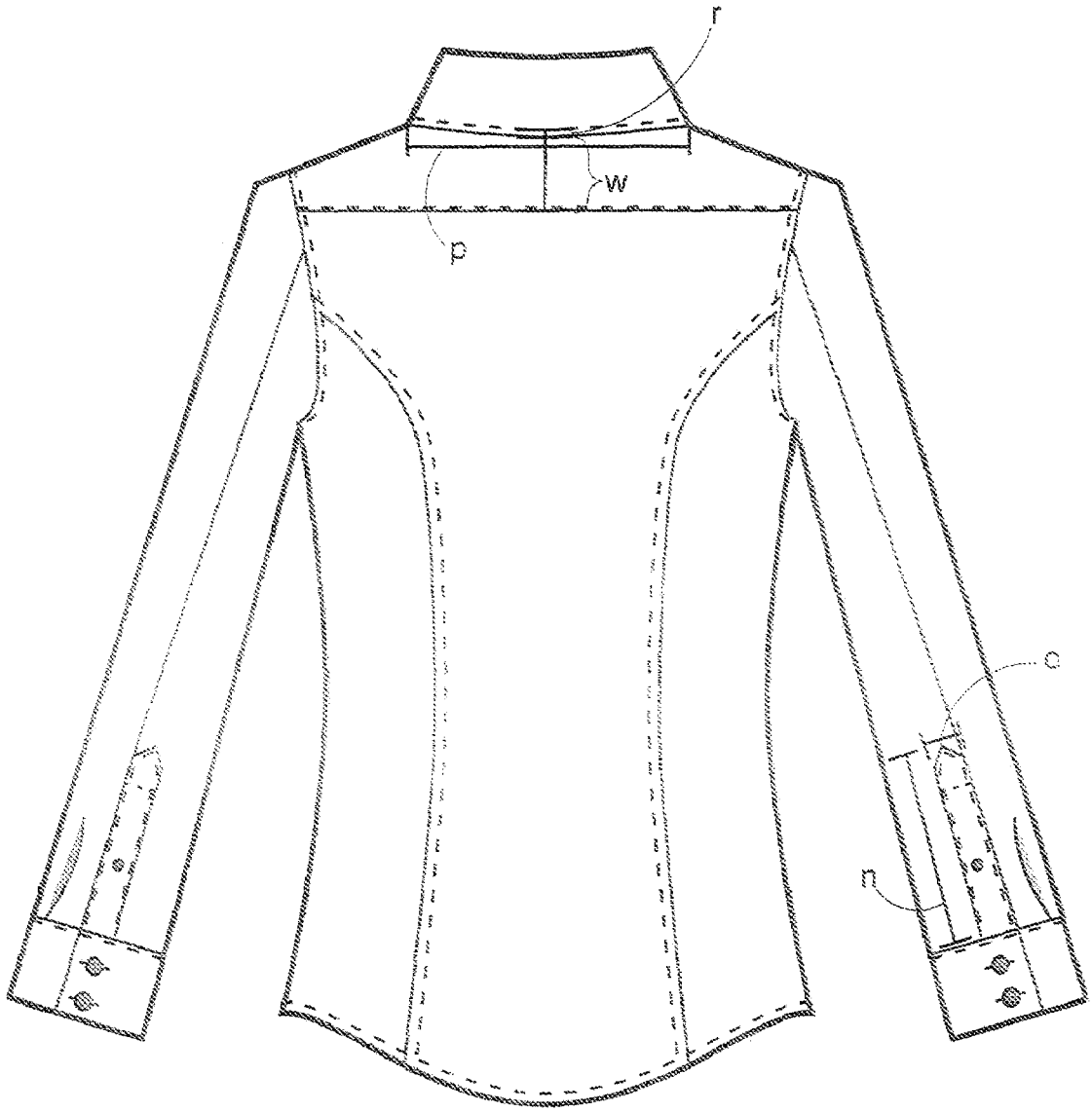
FIG. 5B shows a back view of a shirt, constructed in accordance with one embodiment of the present invention with measurements (n, o, p, r, w) that have been adjusted using standard adjustments.

FIGS. 5A and 5B may show certain additional measurements not discussed in FIG. 2, FIG. 3 or FIG. 4. These measurements (designated l, m, etc.) may be increased or decreased (if at all) as in the prior art, and may form part of the invention in conjunction with the measurement adjustments illustrated in FIGS. 2, 3 and 4 and discussed hereinabove.

To summarize, in a preferred embodiment, the method of this invention described above may specify how the measurements a-x are changed from a master pattern size 34B long to a 34A long, 34C long, 34D long, 34DD long, etc. The measurements of the patterns of different lengths may also be calculated (34A regular, 34B regular, 34C regular, 34D regular, etc.).

The table of FIG. 6 lists the measurements a-x for the Slim Fit Shirt patterns size 34A long, 34B long, 34C long, 34D long and 34DD long. These measurements may differ from the measurements a-x for the Slim Fit Shirt patterns size 34A regular, 34B regular, 34C regular, 34D regular and 34DD regular. In fact, all the measurements may differ with height. At least three measurements of a garment may be adjusted for height. For example, the measurements for body length, high point shoulder to apex and sleeve length may increase in a shirt that is characterized as long.

The tables of FIGS. 7A-E list the actual measurements for the Slim Fit Shirt "Petite" (height<5'2") patterns in all of sizes 30, 32, 34, 36, 38 and 40 and cups A-DD. These measurements may differ from the measurements a-x for the Slim Fit Shirt "Regular" (5'2"≦height<5'6"), "Long" (5'6"≦height<5'11") and "Extra Long" (height≧5'11") patterns. Adjusting these measurements in this manner may allow for a tailored and accurate fit along the waist and hips and above the bust line to prevent bunching and gapping in long patterns.

The table of FIG. 8A shows the percentages by which the measurements of a Slim Fit Shirt pattern size 34B long may be changed to obtain Slim Fit Shirt patterns of size 34A long, 34C long, 34D long and 34DD long. More specifically, as indicated in the table of FIG. 8A, for a Slim Fit Shirt pattern size 34A long, measurement a for a Slim Fit Shirt pattern size 34B long may be decreased by 0.5%, measurement b may be decreased by 2.5%, measurement c may be decreased by 2.1%, etc. For example, in the present invention, for a Slim Fit Shirt pattern size 34B long, the body length a may measure 25.000 inches, as shown in the table of FIG. 8A. To arrive at the body length a for a pattern size 34A long, this measurement may be reduced by 0.5%. In other words, for a pattern size 34A long, the body length a may measure 24.875 inches. To arrive at the body length a for a pattern size 34C long, the body length a for a pattern size 34B long may be increased by 0.5%. In other words, for a pattern size 34C long, the body length a may measure 25.125 inches.

The high point shoulder to apex b for a pattern size 34B long may be reduced by 2.5%, as shown in the table of FIG. 8A, to obtain the high point shoulder to apex b for a pattern size 34A long (9.75 inches). The high point shoulder to apex b for a pattern size 34B long may be increased by 2.5%, as shown in the table of FIG. 8A, to obtain the high point shoulder to apex b for a pattern size 34C long (10.25 inches).

Measurement 1 may not change with bra cup size, but may change with chest circumference. Thus, in the present invention, for a pattern size 34B long, the cuff opening 1 may measure 8.000 inches, as shown in the table of FIG. 8A. The cuff opening 1 for a pattern size 34B long may be changed by 0.0% to obtain the cuff opening 1 for a pattern size 34A long (8.000 inches). The cuff opening 1 for a pattern size 34B long may also be changed by 0.0%, as shown in the table of FIG. 8A, to obtain the cuff opening 1 for a pattern size 34C long (8.000 inches).

The table of FIG. 8B shows the percentages by which the measurements of a Relaxed Fit Shirt pattern size 34B long may be changed to obtain Relaxed Fit Shirt patterns of size 34A long, 34C long, 34D long and 34DD long. More specifically, as indicated in the table of FIG. 8B, for a Relaxed Fit Shirt pattern size 34A long, measurement a for a Relaxed Fit Shirt pattern size 34B long may be decreased by 0.5%, measurement b may be decreased by 2.5%, measurement c may be decreased by 1.9%, etc. For example, in the present invention, for a Relaxed Fit Shirt pattern size 34B long, the chest width c may measure 38.500 inches, as shown in the table of FIG. 8B. To arrive at the chest width c for a pattern size 34A long, this measurement may be reduced by 1.9%. In other words, for a pattern size 34A long, the chest width c may measure about 37.8 inches. To arrive at the chest width c for a pattern size 34C long, the chest width c for a pattern size 34B long may be increased by 3.2%. In other words, for a pattern size 34C long, the chest width c may measure about 39.7 inches.

The table of FIG. 8C shows the percentages by which the measurements of a Halter Shirt pattern size 34B long may be changed to obtain Halter Shirt patterns of size 34A long, 34C long, 34D long and 34DD long. More specifically, as indicated in the table of FIG. 8C, for a Halter Shirt pattern size 34A long, measurement a for a Halter Shirt pattern size 34B long may be decreased by 0.6%, measurement b may be decreased by 2.5%, measurement c may be decreased by 2.1%, etc. For example, in the present invention, for a Halter Shirt pattern size 34B long, the bottom width d may measure 36.000 inches, as shown in the table of FIG. 8C. To arrive at the bottom width d for a pattern size 34D long, this measurement may be increased by 2.8%. In other words, for a pattern size 34D long, the bottom width d may measure about 37.0 inches. To arrive at the bottom width d for a pattern size 34DD long, the bottom width d for a pattern size 34B long may be increased by 4.9%. In other words, for a pattern size 34DD long, the bottom width d may measure about 37.8 inches.

The table of FIG. 8D shows the percentages by which the measurements of a "Sophie Hudson Missy Fit 10007" Shirt pattern size 34B long may be changed to obtain "Sophie Hudson Missy Fit 10007" Shirt patterns of size 34A long, 34C long, 34D long and 34DD long. More specifically, as indicated in the table of FIG. 8D, for a "Sophie Hudson Missy Fit 10007" Shirt pattern size 34A long, measurement a for a "Sophie Hudson Missy Fit 10007" Shirt pattern size 34B long may be decreased by 0.5%, measurement b may be decreased by 2.3%, measurement c may be decreased by 2.0%, etc. For example, in the present invention, for a "Sophie Hudson Missy Fit 10007" Shirt pattern size 34B long, the waist e may measure 31.000 inches, as shown in the table of FIG. 8D. To arrive at the waist e for a pattern size 34D long, this measurement may be increased by 3.2%. In other words, for a pattern size 34D long, the waist e may measure about 32 inches. To arrive at the waist e for a pattern size 34DD long, the waist e for a pattern size 34B long may be increased by 5.6%. In other words, for a pattern size 34DD long, the waist e may measure about 32.8 inches.

The table of FIG. 8E shows the percentages by which the measurements of a "Sophie Hudson Missy Fit 10008" Shirt pattern size 34B long may be changed to obtain "Sophie Hudson Missy Fit 10008" Shirt patterns of size 34A long, 34C long, 34D long and 34DD long. More specifically, as indicated in the table of FIG. 8E, for a "Sophie Hudson Missy Fit 10008" Shirt pattern size 34A long, measurement a for a "Sophie Hudson Missy Fit 10008" Shirt pattern size 34B long may be decreased by 1.0%, measurement b may be decreased by 2.4%, measurement c may be decreased by 0.7%, etc. For example, in the present invention, for a "Sophie Hudson Missy Fit 10008" Shirt pattern size 34B long, the cross front f may measure 13.750 inches, as shown in the table of FIG. 8E. To arrive at the cross front f for a pattern size 34D long, this measurement may be increased by 1.8%. In other words, for a pattern size 34D long, the cross front f may measure about 14.00 inches. To arrive at the cross front f for a pattern size 34DD long, the cross front f for a pattern size 34B long may be increased by 2.7%. In other words, for a pattern size 34DD long, the cross front f may measure about 14.1 inches.

The table of FIG. 9A shows the resulting values of the various measurements a-x of a "Sophie Hudson Women's Fit 10007" Shirt, in percentages, using the pattern size 34B long as the base for the other sizes. More specifically, as indicated in the table of FIG. 9A, for patterns size 34A long, measurement a may be 99.5% of patterns size 34B long; measurement b may be 97.7% of patterns size 34B long; etc. For patterns size 34C long, measurement a may be 100.5% of patterns size 34B long; measurement b may be 104.7% of patterns size 34B long; and so on.

The table of FIG. 9B shows the resulting values of the various measurements a-x of a "Sophie Hudson Women's Fit 10008" Shirt, in percentages, using the pattern size 34B long as the base for the other sizes. More specifically, as indicated in the table of FIG. 9B, for patterns size 34D long, measurement c may be 105.8% of patterns size 34B long; measurement d may be 102.7% of patterns size 34B long; etc. For patterns size 34DD long, measurement c may be 108.0% of patterns size 34B long; measurement d may be 104.2% of patterns size 34B long; and so on.

The table of FIG. 9C shows the resulting values of the various measurements a-x of a "Marie" Shirt, in percentages, using the pattern size 34B long as the base for the other sizes. More specifically, as indicated in the table of FIG. 9C, for patterns size 34A long, measurement d may be 98.7% of patterns size 34B long; measurement e may be 98.3% of patterns size 34B long; etc. For patterns size 34C long, measurement d may be 101.3% of patterns size 34B long; measurement e may be 101.7% of patterns size 34B long; and so on.

The table of FIG. 9D shows the resulting values of the various measurements a-x of a Slim Fit Shirt, in percentages, using the pattern size 34B long as the base for the other sizes. More specifically, as indicated in the table of FIG. 9D, for patterns size 34D long, measurement f may be 102.0% of patterns size 34B long; measurement g may be 101.7% of patterns size 34B long; etc. For patterns size 34DD long, measurement f may be 102.9% of patterns size 34B long; measurement g may be 102.5% of patterns size 34B long; and so on.

The table of FIG. 9E shows the resulting values of the various measurements a-x of a Relaxed Fit Shirt, in percentages, using the pattern size 34B long as the base for the other sizes. More specifically, as indicated in the table of FIG. 9E, for patterns size 34A long, measurement h may be 99.1% of patterns size 34B long; measurement i may be 99.3% of patterns size 34B long; etc. For patterns size 34C long, measurement h may be 100.9% of patterns size 34B long; measurement i may be 100.7% of patterns size 34B long; and so on.

FIG. 10 shows the pattern pieces for a shirt, in accordance with one embodiment of the present invention. More specifically, a shirt in accordance with one embodiment of the present invention may be constructed using left and right front pattern pieces, two side front panel pieces, a center front placket, two back side panel pieces, a back pattern piece, a back yoke piece, two sleeve pattern pieces, two cuff pieces, two sleeve plackets, a top collar piece, an under collar piece and a collar stand.

Figure 11:
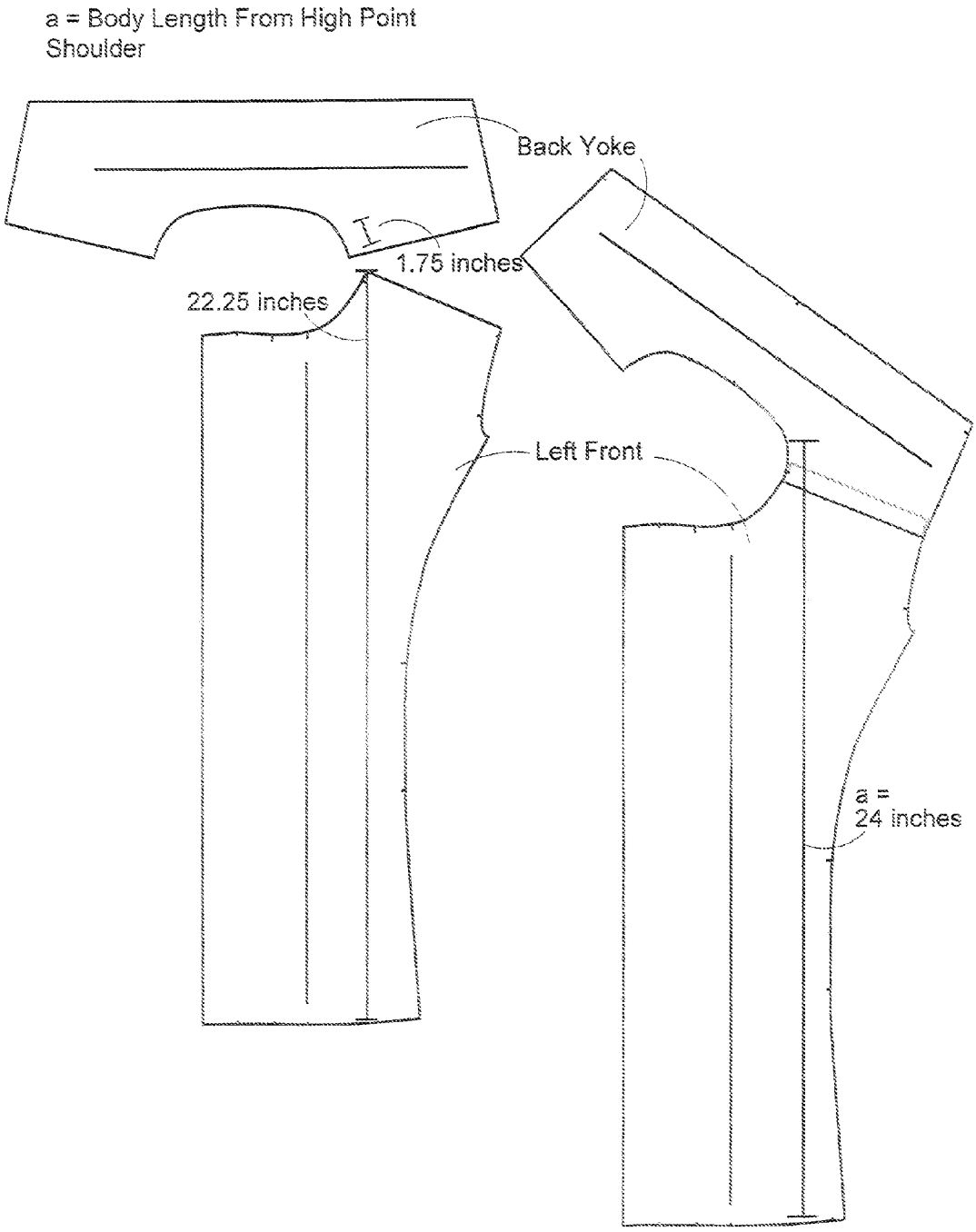
FIG. 11 shows the measurement a on the left front pattern piece and back yoke piece, in accordance with one embodiment of the present invention.

FIG. 11 shows the measurement a on the left front pattern piece and the back yoke piece, in accordance with one embodiment of the present invention. More specifically, a Slim Fit Shirt size 34B long in accordance with one embodiment of the present invention may be constructed using a left front pattern piece measuring 22.25 inches and a back yoke piece comprising 1.75 inches of the total 24 inches in body length. As understood by one skilled in the art, inherent discrepancies that result from measuring flat paper pattern pieces using a hard ruler, as opposed to measuring the actual garment using a soft measuring tape, as well as changes that occur during the manufacturing process as the fabric is cut, sewn, stretched, steamed and pressed, account for the difference between the measurement of the pattern pieces and the measurement of the actual garment (25 inches as shown, for example, in the table of FIG. 6 described hereinabove).

Figure 12:
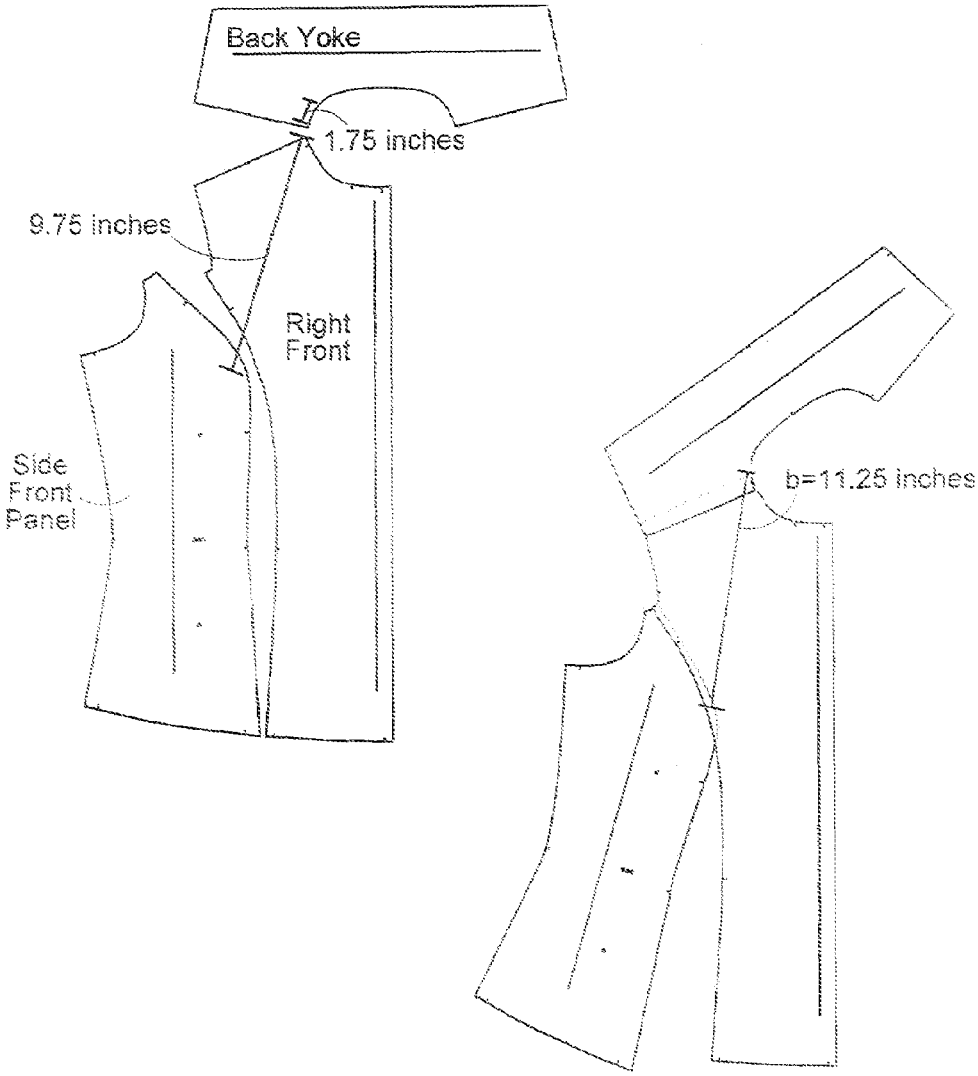
FIG. 12 shows the measurement b on the right front pattern piece, a side front panel piece and the back yoke piece, in accordance with one embodiment of the present invention.

FIG. 12 shows the measurement b on the right front pattern piece, a side front panel piece and the back yoke piece, in accordance with one embodiment of the present invention. Thus, a Slim Fit Shirt size 34B long in accordance with one embodiment of the present invention may be constructed using a right front pattern piece comprising 9.75 inches of the measurement from the high point shoulder to the apex, a back yoke piece comprising 1.75 inches of the measurement, and a side front panel piece. After the pieces are sewn together the measurement totals 11.25 inches. Again, as explained hereinabove, this measurement differs from the 10 inches shown in the table of FIG. 6 because of inherent discrepancies that arise from different measuring procedures and from alterations to the fabric, once the pattern is made in fabric.

Figure 13:
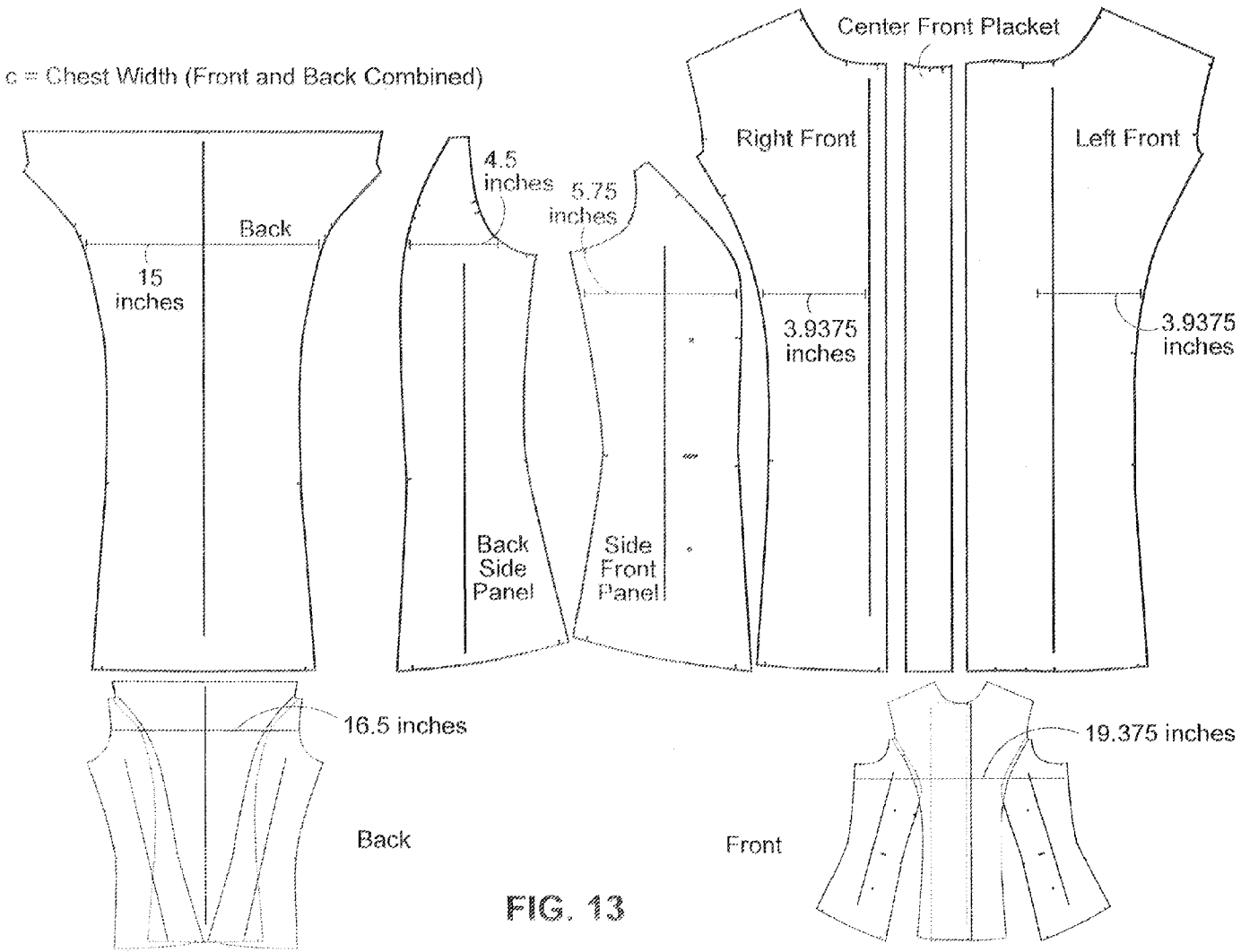
FIG. 13 shows the measurement c on the left and right front pattern pieces, a side front panel piece, the center front placket, a back side panel piece and the back pattern piece, in accordance with one embodiment of the present invention.

FIG. 13 shows the measurement c on the left and right front pattern pieces, a side front panel piece, the center front placket, a back side panel piece and the back pattern piece, in accordance with one embodiment of the present invention. The chest width c for a Slim Fit Shirt pattern size 34B long may be comprised of 3.9375 inches on each of the left and right front pattern pieces, 5.75 inches on each of the side front panel pieces, 4.5 inches on each of the back side panel pieces and 15 inches on the back pattern piece, totaling 19.375 inches in the front and 16.5 inches in the back. Again, this measurement is different from the 36 inches shown, for example, in the table of FIG. 6 described hereinabove, because of inherent discrepancies arising from measuring tools and changes made to the fabric, once the pattern is made in fabric.

Figure 14:
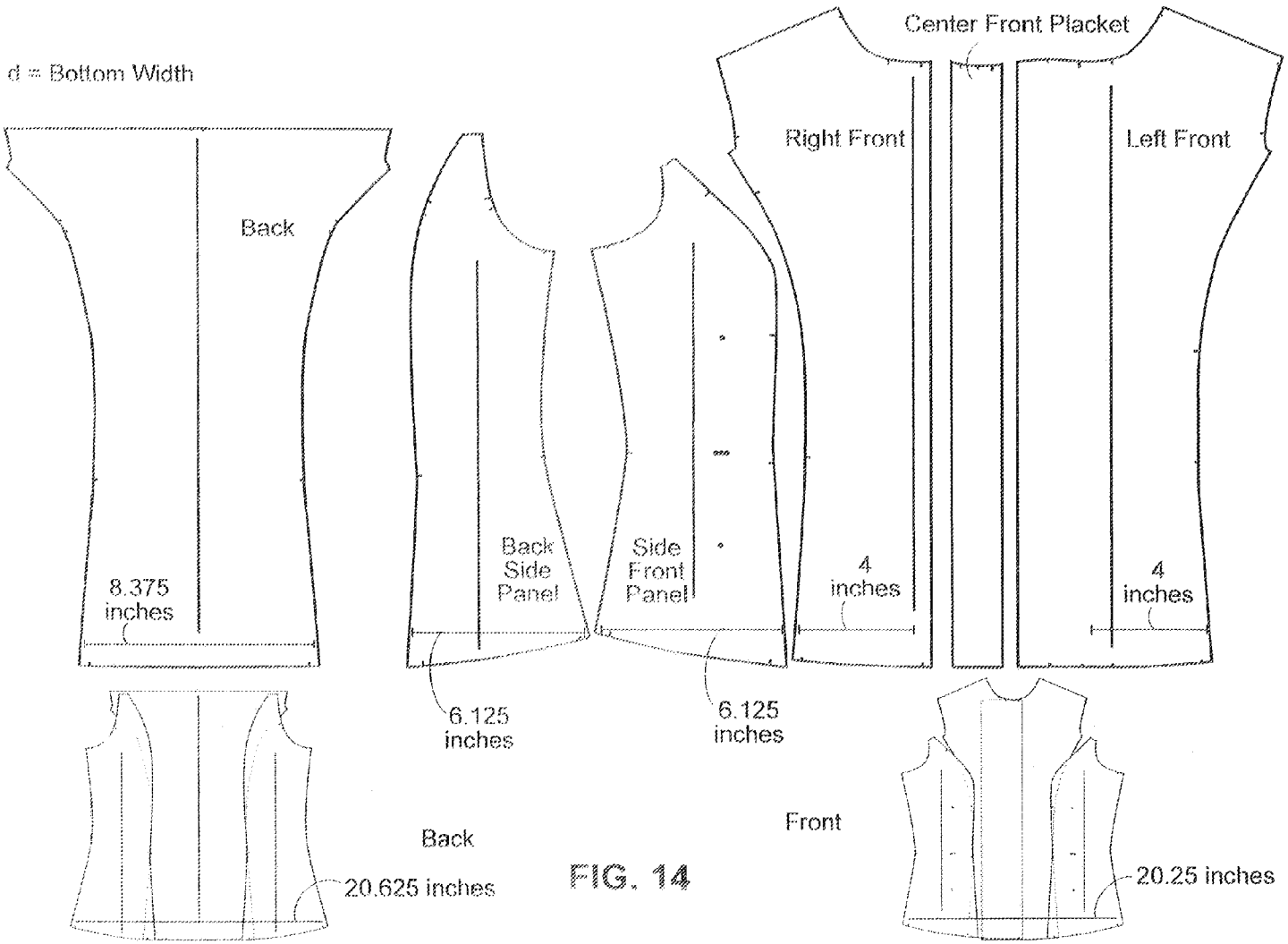
FIG. 14 shows the measurement d on the left and right front pattern pieces, a side front panel piece, the center front placket, a back side panel piece and the back pattern piece, in accordance with one embodiment of the present invention.

FIG. 14 shows the measurement d on the left and right front pattern pieces, a side front panel piece, the center front placket, a back side panel piece and the back pattern piece, in accordance with one embodiment of the present invention. Thus, in the present invention, for a Slim Fit Shirt pattern size 34B long, the bottom may measure 4 inches across each of the left and right front pattern pieces, 6.125 inches across each of the side front panel pieces and back side panel pieces and 8.375 inches across the back pattern piece, totaling 20.25 inches in the front and 20.625 inches in the back. Again, as explained hereinabove, this measurement differs from the 38.5 inches shown, for example, in the table of FIG. 6 described hereinabove, because of inherent discrepancies arising from measuring tools and changes made to the fabric, once the pattern is made in fabric.

Figure 15:
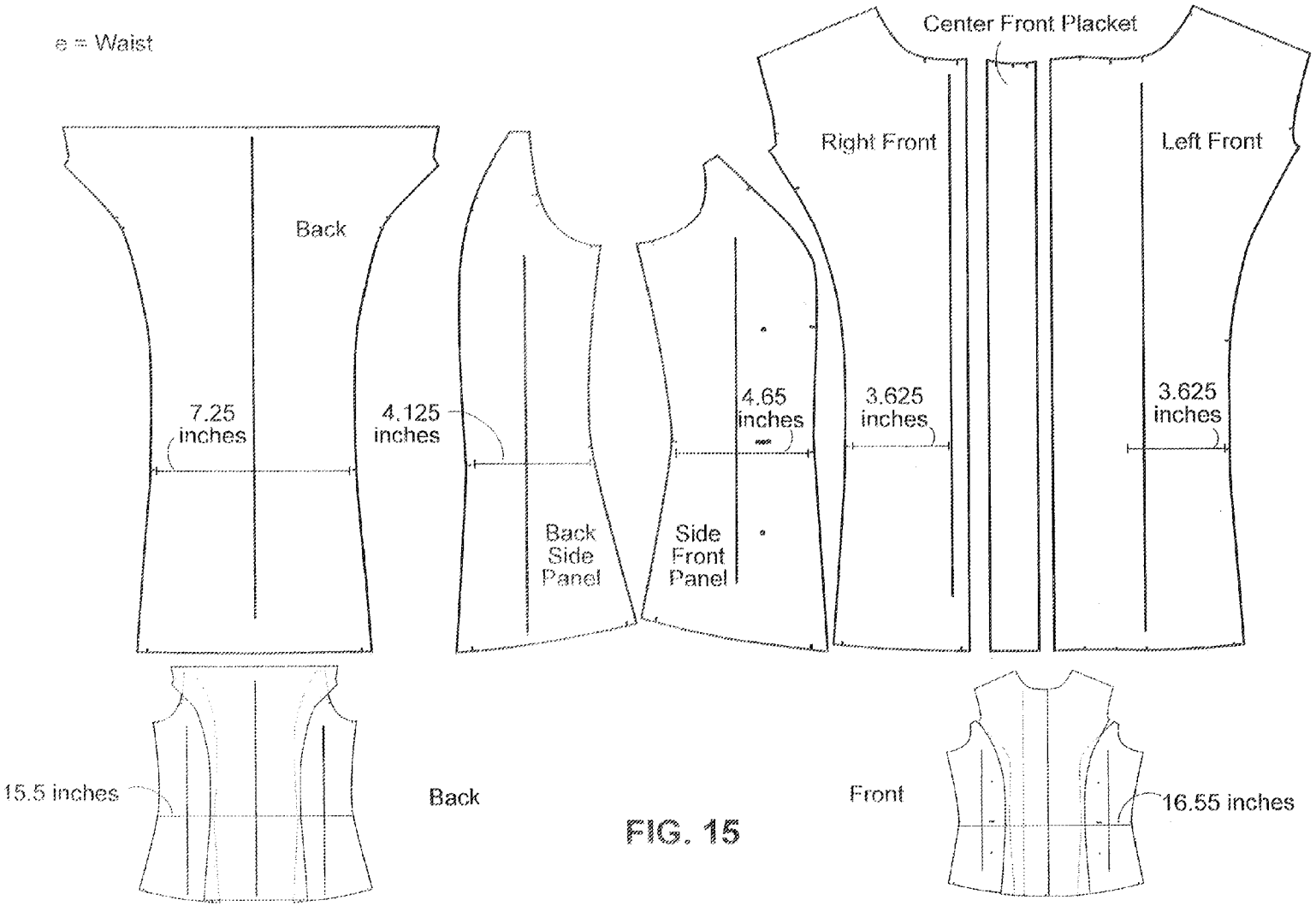
FIG. 15 shows the measurement e on the left and right front pattern pieces, a side front panel piece, the center front placket, a back side panel piece and the back pattern piece, in accordance with one embodiment of the present invention.

FIG. 15 shows the measurement e on the left and right front pattern pieces, a side front panel piece, the center front placket, a back side panel piece and the back pattern piece, in accordance with one embodiment of the present invention. To arrive at a Slim Fit Shirt pattern size 34B long, the waist may measure 3.625 inches across each of the left and right front pattern pieces, 4.65 inches across each of the side front panel pieces, 4.125 inches across each of the back side panel pieces and 7.25 inches across the back pattern piece, totaling 16.55 inches in the front and 15.5 inches in the back. Again, as explained hereinabove, this measurement differs from the 30.5 inches shown, for example, in the table of FIG. 6 described hereinabove, because of inherent discrepancies arising from measuring tools and changes made to the fabric, once the pattern is made in fabric.

Figure 16:
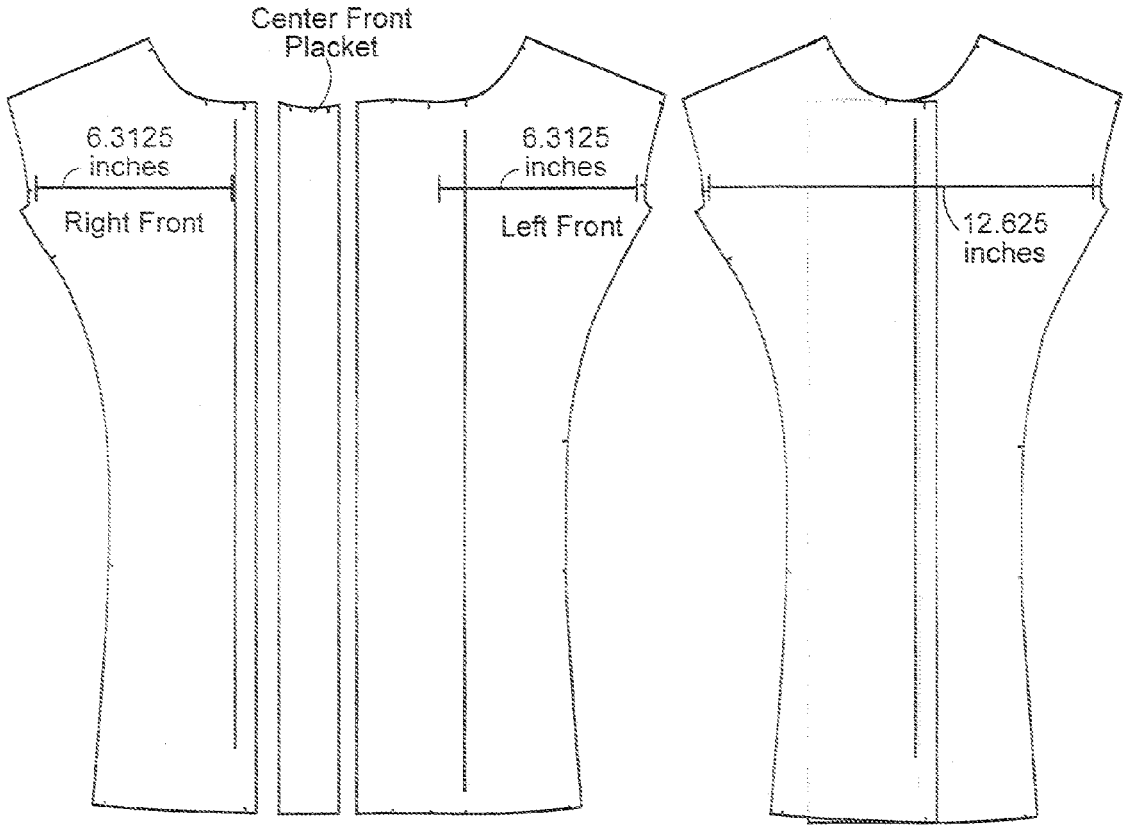
FIG. 16 shows the measurement f on the left and right front pattern pieces and the center front placket, in accordance with one embodiment of the present invention.

FIG. 16 shows the measurement f on the left and right front pattern pieces and the center front placket, in accordance with one embodiment of the present invention. In other words, for a Slim Fit Shirt pattern size 34B long, the cross front may measure 6.3125 inches across each of the left and right front pattern pieces, totaling 12.625 inches. Again, as explained hereinabove, this measurement differs from the 12.75 inches shown, for example, in the table of FIG. 6 described hereinabove, because of inherent discrepancies that arise from differing measuring tools and changes made to the fabric, once the pattern is made in fabric.

Figure 17:
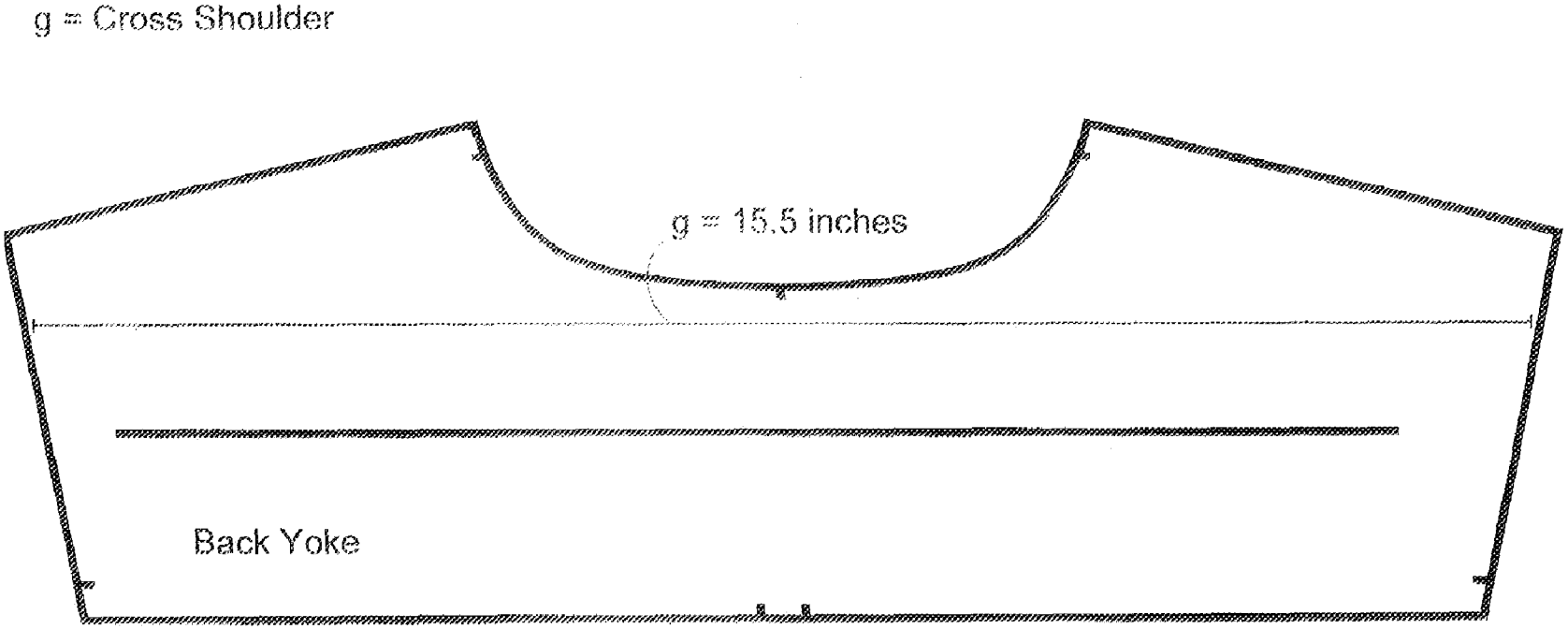
FIG. 17 shows the measurement g on the back yoke pattern piece, in accordance with one embodiment of the present invention.

FIG. 17 shows the measurement g on the back yoke pattern piece, in accordance with one embodiment of the present invention. For example, in the present invention, for a Slim Fit Shirt pattern size 34B long, the back yoke pattern piece may measure 15.5 inches, which differs from the 15 inches shown, for example, in the table of FIG. 6, as the cross shoulder measurement, because of inherent discrepancies that arise from differing measuring tools and changes made to the fabric during the manufacturing process, once the pattern is made in fabric.

Figure 18:
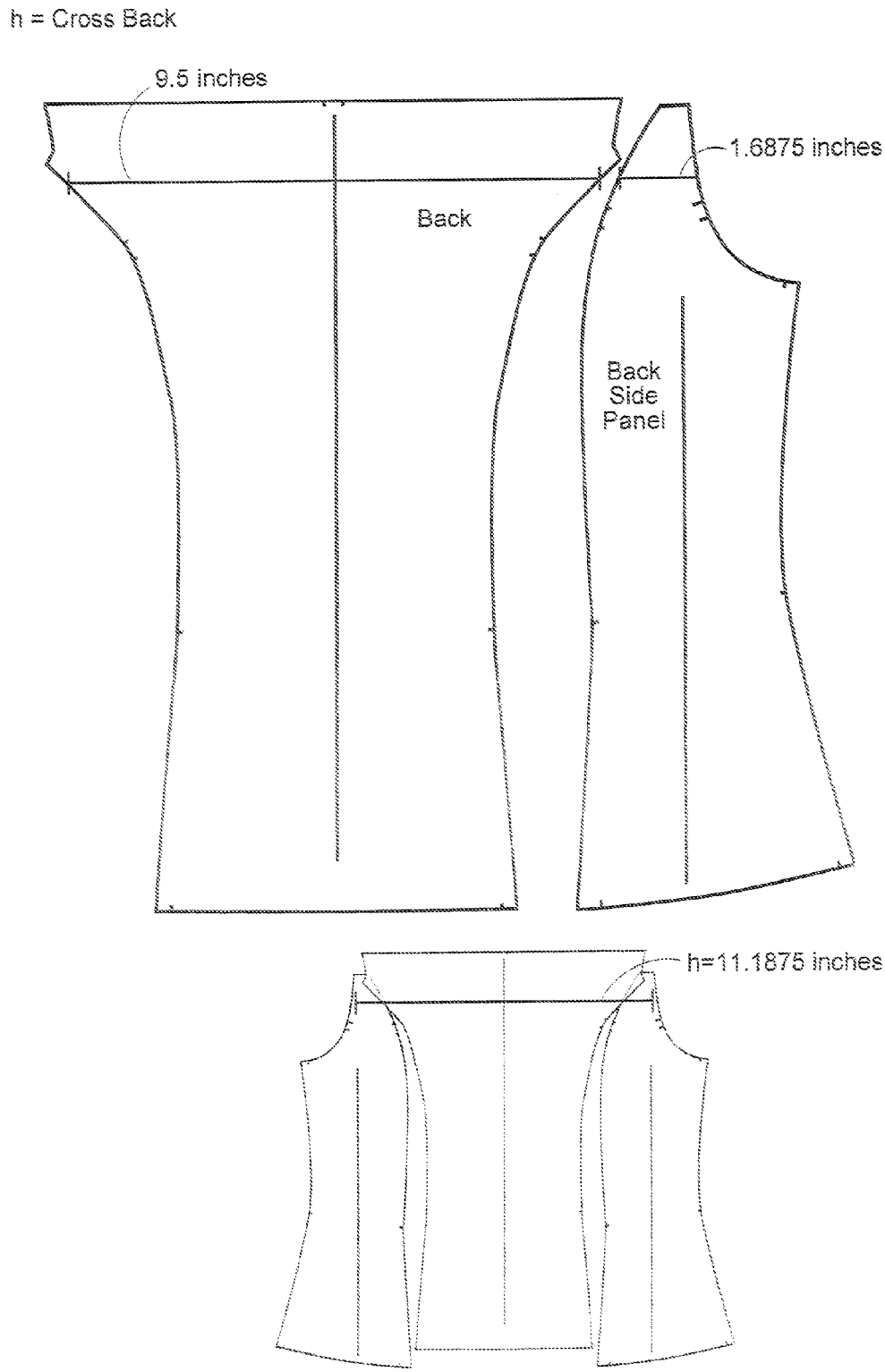
FIG. 18 shows the measurement h on the back pattern piece and a back side panel piece, in accordance with one embodiment of the present invention.

FIG. 18 shows the measurement h on the back pattern piece and a back side panel piece, in accordance with one embodiment of the present invention. Adjusting the cross back measurement across the back pattern piece of a Slim Fit Shirt to measure 9.5 inches and 1.6875 inches across each of two back side panel pieces to total 11.1875 inches may allow for a tailored and accurate fit. Again, this measurement differs from the 13.75 inches shown, for example, in the table of FIG. 6, because of inherent discrepancies that arise from differing measuring tools and changes made to the fabric, once the pattern is made in fabric.

Figure 19:
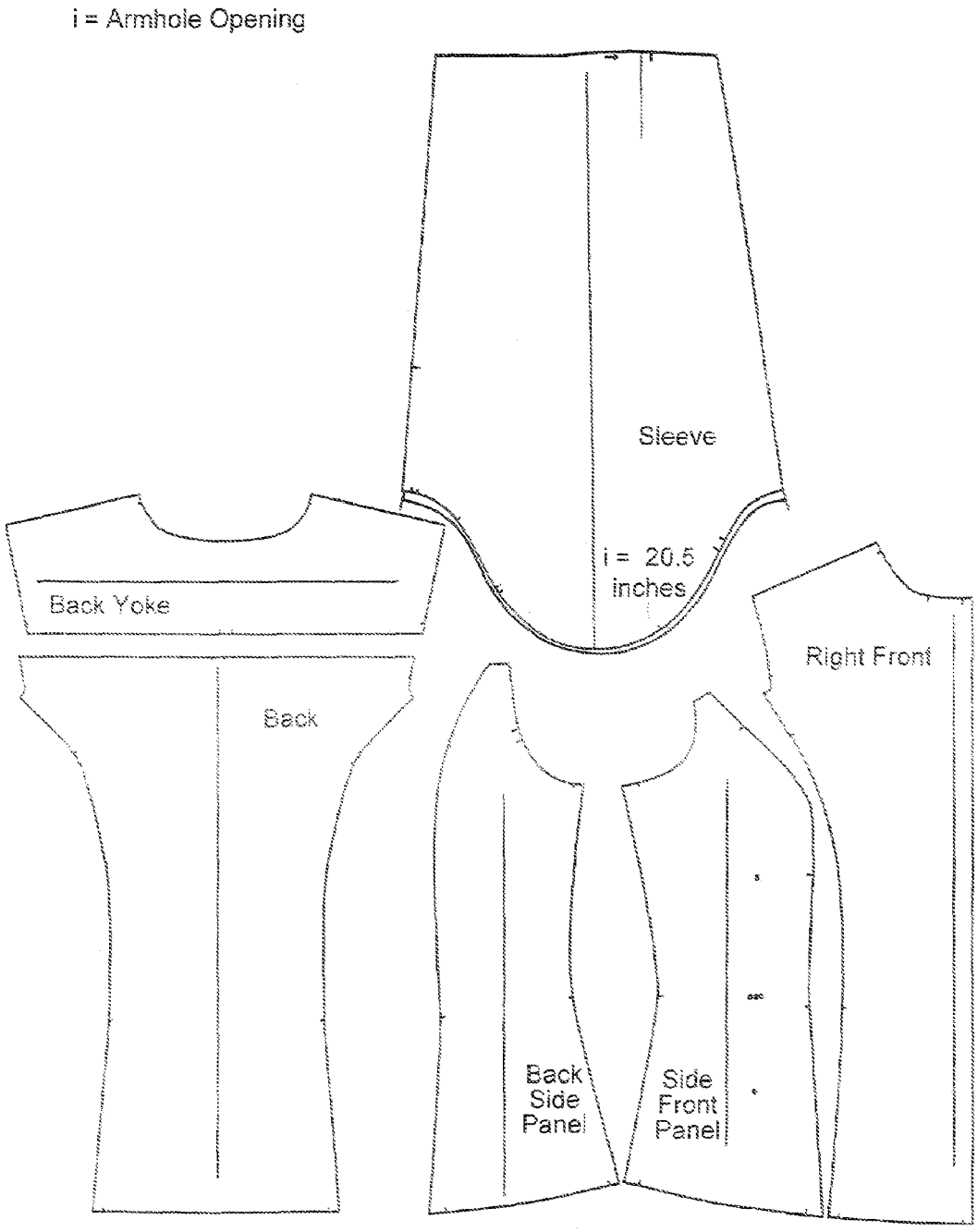
FIG. 19 shows the measurement i on a sleeve pattern piece, and the other pattern pieces that are involved in the measurement, the right front pattern piece, a side front panel piece, a back side panel piece, the back pattern piece and the back yoke piece, in accordance with one embodiment of the present invention.

FIG. 19 shows the measurement i on the right front pattern piece, a side front panel piece, a back side panel piece, the back pattern piece, the back yoke piece and a sleeve pattern piece, in accordance with one embodiment of the present invention. The armhole opening of a Slim Fit Shirt may measure 20.5 inches along the edge of the sleeve. Again, this measurement differs from the 19 inches shown, for example, in the table of FIG. 6, because of inherent discrepancies that arise from differing measuring tools and changes made to the fabric, once the pattern is made in fabric.

Figure 20:
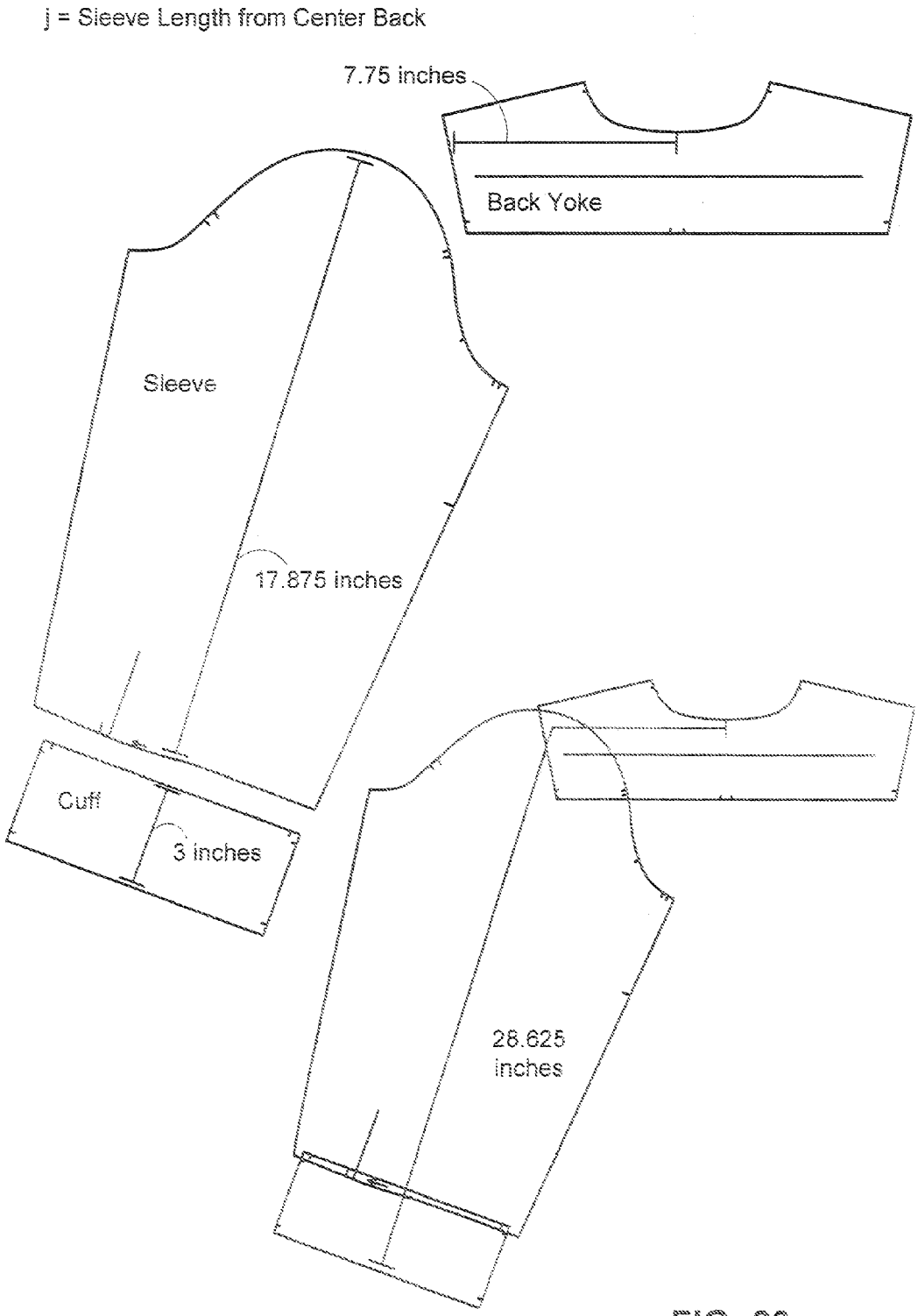
FIG. 20 shows the measurement j on a sleeve pattern piece, the back yoke piece and a cuff pattern piece, in accordance with one embodiment of the present invention.

FIG. 20 shows the measurement j on a cuff pattern piece, a sleeve pattern piece and the back yoke piece, in accordance with one embodiment of the present invention. To arrive at the sleeve length from the center back for a Slim Fit Shirt pattern size 34B long, the cuff pattern piece may measure 3 inches, the sleeve pattern piece may measure 17.875 inches and the back yoke piece may comprise 7.75 inches of the measurement for a total measurement of 28.625 inches. Again, this measurement differs from the 32 inches shown, for example, in the table of FIG. 6, because of inherent discrepancies that arise from differing measuring tools and changes made to the fabric, once the pattern is made in fabric.

Figure 21A:
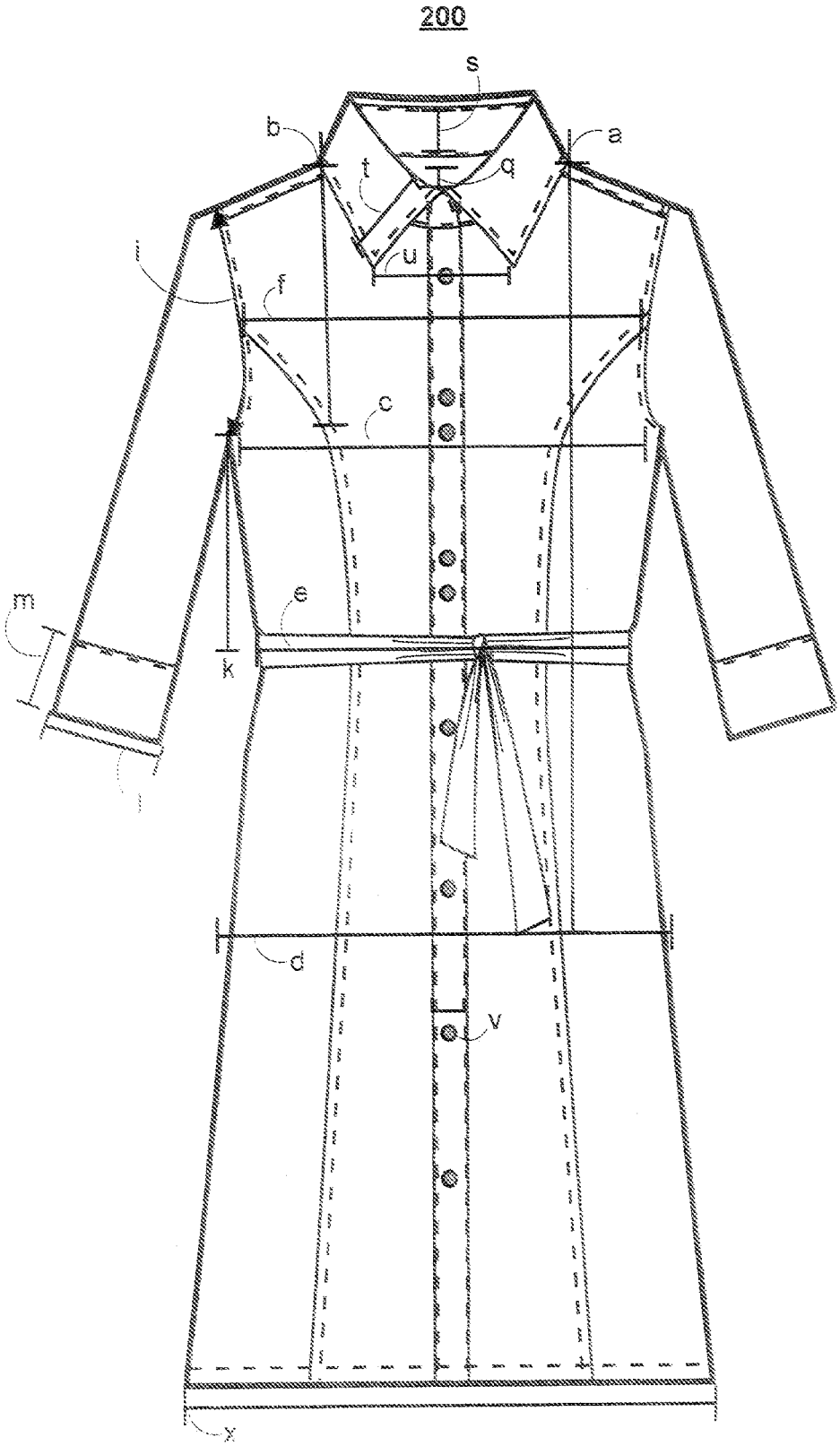
FIG. 21A shows a frontal view of a Slim Fit Shirt-Dress, indicating how measurements may be defined in accordance with one embodiment of the present invention.
Figure 21B:
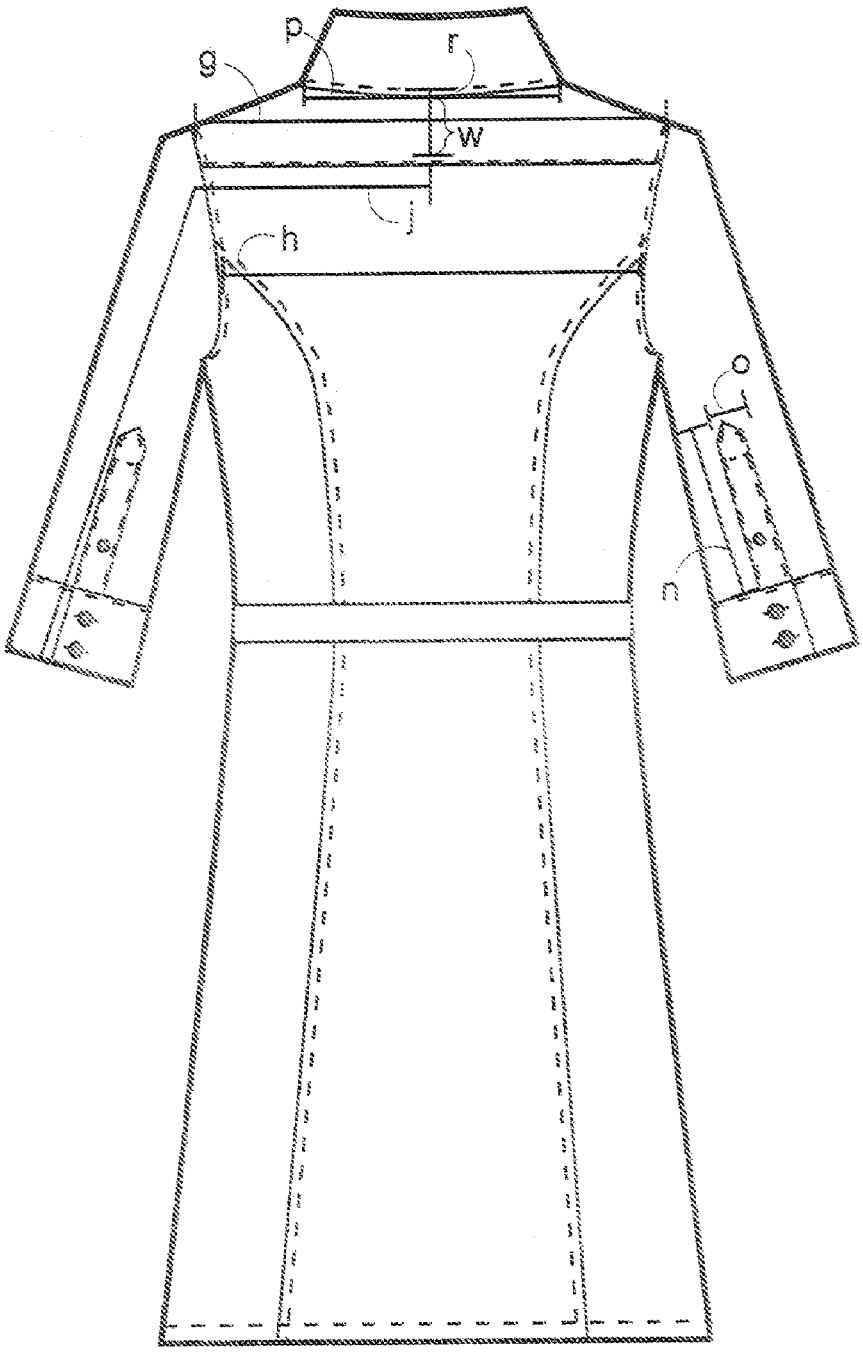
FIG. 21B shows a back view of a Slim Fit Shirt-Dress, indicating how measurements may be defined in accordance with one embodiment of the present invention.

Turning now to FIGS. 21A and 21B, another embodiment of the invention is shown. A shirt-dress 200 is shown with standard measurements a-x; FIG. 21C indicates where each such measurement is taken, and the values of the various measurements a-x for a Slim Fit Shirt-Dress pattern sizes 34A-DD long. For instance, measurement w refers to the sweep or hem circumference (front and back combined) of the shirt-dress. Knowing these measurements, a person skilled in the art can make a master pattern for shirt-dress 200.

A line of shirt-dresses made in accordance with this invention can generally be described as follows: First, a master shirt-dress pattern for the chosen body type and shirt style may be designed for a particular size, such as 34B long. The measurements of this master shirt-dress pattern may be used to make several other patterns for different bra cup sizes, and for different lengths, e.g., 34A regular, 34B regular, 34C regular, 34D regular, 34DD regular, 34F regular, 34G regular, 34A long, 34C long, etc., using the innovative algorithm expressed above.

Thus, to obtain measurement a for a Slim Fit Shirt-Dress size 34A long, measurement a for a Slim Fit Shirt-Dress size 34B long may be decreased by 100−99.7=0.3%; to obtain measurement b for a Slim Fit Shirt-Dress size 34A long, measurement b for a Slim Fit Shirt-Dress size 34B long may be decreased by 100-97.5=2.5%; etc. The foregoing algorithm can advantageously be expanded to include bra cup sizes smaller than A and larger than G, as well as all other bra cup sizes (or fractions thereof), e.g., A+, A-, etc., and also any other intermediate sizes.

It has been explained herein that in accordance with this invention, it has been recognized that grading proportionally, regardless of an individual's personal size, girth and other relevant measurements, ignores the basic "customizing" that people have come to look for in a garment. However, because most consumers do not wish to pay for expensive tailoring or other custom making, this invention provides that a more individualized and yet stylish garment fit can be obtained using measurements that are ascertained by a garment manufacturer with a predetermined size-related algorithm. While a number of measurements of a garment may be obtained in the same manner as before under the present invention, i.e., being graded proportionally up or down depending upon the individual's size and girth, other particular measurements, most notably related to the individual's chest circumference, bra cup size and height, may vary in a different manner, pursuant to an embodiment of this invention, to achieve a much more individualized fitting for such an individual's garment.

By focusing on the individual's chest circumference, bra cup size and height, a myriad of problems associated with prior art garments and their ill-fitting nature may be overcome using the present invention. Although complaints from individuals over many years raised this type of problem, no solution prior to the present invention ever has achieved a balance between some standardized measurements and some individual or custom-like measurements, providing a special and unique fit to individuals of particular sizes.

It is recognized that in accordance with the principles of this invention, variations in the sizing and applicability to various classes of garments can be arrived at to implement the principles of the present invention. For example, although the embodiments of the invention detailed throughout the present application thus far have been articulated generally for garments that include at least a shirt and a shirt-dress, other embodiments of the inventions may also include other apparel covering at least part of a wearer's upper body including but not limited to woven tops, cut-and-sew knit tops, fully-fashioned knit tops, jackets, coats, blazers, other outerwear and dresses, gowns, t-shirts, polo shirts, sweaters, sweatshirts and tank tops. Moreover, by applying the same principles to other physical characteristics of a wearer's body, garments for other portions of a wearer's body also may be created.

From the foregoing description of embodiments of the invention, other embodiments will suggest themselves to those skilled in the art. The foregoing is merely illustrative of the principles of this invention and various modifications can be made by those skilled in the art without departing from the scope and spirit of the invention. The embodiments of the invention described herein are presented for purposes of illustration and not of limitation, and the invention is limited only by the claims which follow.

What is claimed is:

1. A method for optimally adjusting measurements of an outer garment that covers at least part of a wearer's upper body, comprising:

designing the outer garment in a first size;

creating the outer garment in a second size, wherein:

the second size differs from the first size in bra cup size;

the creating is accomplished by adjusting fewer than all measurements of the outer garment in the first size to obtain the measurements of the outer garment in the second size, wherein the adjustment is made based on a standardized set of corrections related to the bra cup size of the second size; and the measurements provide for a predetermined degree of conformance to the wearer's upper body.

2. The method of claim 1, wherein a correction within the standardized set of corrections identifies at least one percentage by which the fewer than all measurements are adjusted.

3. The method of claim 1, wherein the second size further differs from the first size in length, and a correction within the set of corrections identifies at least one number of inches by which the fewer than all measurements are adjusted.

4. The method of claim 1, wherein the second size further differs from the first size in length, a correction within the standardized set of corrections identifies a percentage by which at least one of the fewer than all measurements is adjusted, and another correction within the standardized set of corrections identifies a number of inches by which the at least one of the fewer than all measurements or another of the fewer than all measurements is adjusted.

5. The method of claim 1, wherein the first size is designed for a wearer of bra cup size B and height greater than or equal to five feet and six inches and less than five feet and eleven inches.

6. The method of claim 5, wherein the measurements include one or more of measurements $a=(a_0*Q)+K$, $b=(b_0*R)+L$, $c=c_0*S$, $d=d_0*T$, $e=e_0*U$, $f=f_0*V$, $g=g_0*W$, $h=h_0*X$, $i=i_0*Y$, $j=j_0+M$, $k=k_0+N$, $l=l_0$, $m=m_0$, $n=n_0$, $o=o_0$, $p=p_0$, $q=q_0$, $r=r_0$, $s=s_0$, $t=t_0$, $u=u_0$, $v=v_0$, $w=w_0$ and $x=x_0*Z$, where the measurements a-x represent body length, high point shoulder to apex point of the breast, chest width, bottom width, waist, cross front, cross shoulder, cross back, armhole opening, sleeve length, armhole bottom to waist, cuff opening, cuff width, sleeve placket length, sleeve placket width, back neck width, front neck drop, back neck drop, collar band width, collar width, collar spread, center front placket width, yoke and sweep, respectively, the measurements $a_0$-$x_0$ represent the measurements a-x in the first size, and the adjusting is made according to the following formula:

if the second size is designed for a wearer of bra cup size A, then Q=99.7%, R=97.5%, S=97.9%, T=98.7%, U=98.4%, V=98.9%, W=99.1X=99.1%, Y=99.3%, Z=98.9%;

if the second size is designed for a wearer of bra cup size C, then Q=100.3%, R=102.5%, S=103.6%, T=101.3%, U=101.6%, V=101.1%, W=100.9%, X=100.9%, Y=100.7%, Z=101.1%;

if the second size is designed for a wearer of bra cup size D, then Q=100.6%, R=104.9%, S=107%, T=102.5%, U=103.3%, V=102.1%, W=101.7%, X=101.9%, Y=101.3%, Z=102.2%;

if the second size is designed for a wearer of bra cup size DD, then Q=101%, R=109.7%, S=110.4%, T=104.4%, U=105.6%, V=1031%, W=102.5%, X=102.8%, Y=102%, Z=103.9%;

if the second size is designed for a wearer of bra cup size F, then Q=103.2%, R=115.7%, S=111.3%, T=105.8%, U=106.8%, V=103.3%, W=103%, X=103%, Y=104.2%, Z=105%;

if the second size is designed for a wearer of bra cup size G, then Q=104.1%, R=117.8%, S=111.5%, T=107.3%, U=108.6%, V=104.1%, W=103.7%, X=103.8%, Y=105.4%, Z=106.1%;

if the second size is designed for a wearer of bra cup size B, then Q=R=S=T=U=V=W=X=Y=Z=100%;

and if the second size is designed for a wearer of height less than five feet and two inches, then K=−3.5", L=−0.875", M=−3.51", N=−1.75";

if the second size is designed for a wearer of height greater than or equal to five feet and two inches and less than five feet and six inches, then K=−2", L=−0.5", M=−2', N=−1";

if the second size is designed for a wearer of height greater than or equal to five feet and eleven inches, then K=2", L=0.5", M=2", N=1";

if the second size is designed for a wearer of height greater than or equal to five feet and six inches and less than five feet and eleven inches, then K=L=M=N=0;

and any one or more of a-x may vary +/−2%.

7. The method of claim 1, wherein the outer garment is at least one of a:

shirt;
woven top;
cut-and-sew knit top;
fully-fashioned knit top;
jacket;
coat;
blazer;
outerwear;
shirt-dress;
dress;
gown;
t-shirt;
polo shirt;
sweater;
sweatshirt; and
tank top.

8. The method of claim 1, wherein the outer garment is formed of at least one of a woven fabric, a knit fabric, knitted yarns, a lace material, a cotton material, a polyester material, a denim material, a leather material, a suede material, a natural fur material, a synthetic fur material, a linen material, a wool material, a corduroy material and materials comprising natural or synthetic blended fibers.

9. An outer garment being formed of sufficient size to provide for a predetermined degree of conformance to a wearer's upper body, wherein the outer garment in a second size, differing from a first size in bra cup size, has measurements optimally adjusted from measurements of the outer garment in the first size, based on a standardized set of corrections related to the bra cup size of the second size, said measurements including measurements, fewer than all of which are adjusted based on the wearer's bra cup size.

10. The outer garment of claim 9, wherein a correction within the standardized set of corrections identifies at least one percentage by which the fewer than all measurements are adjusted.

11. The outer garment of claim 9, wherein the second size further differs from the first size in length, and a correction within the standardized set of corrections identifies at least one number of inches by which the fewer than all measurements are adjusted.

12. The outer garment of claim 9, wherein the second size further differs from the first size in length, a correction within the standardized set of corrections identifies a percentage by which at least one of the fewer than all measurements is adjusted, and another correction within the standardized set of corrections identifies a number of inches by which the at least one of the fewer than all measurements or another of the fewer than all measurements is adjusted.

13. The outer garment of claim 12, wherein the first size is designed for a wearer of bra cup size B and height greater than or equal to five feet and six inches and less than five feet and eleven inches.

14. The outer garment of claim 13, wherein the measurements include one or more of measurements $a=(a_0*Q)+K$, $b=(b_0*R)+L$, $c=c_0*S$, $d=d_0*T$, $e=e_0*U$, $f=f_0*V$, $g=g_0*W$, $h=h_0*X$, $i=i_0*Y$, $j=j_0+M$, $k=k_0+N$, $l=l_0$, $m=m_0$, $n=n_0$, $o=o_0$, $p=p_0$, $q=q_0$, $r=r_{0\ s=s0}$, $t=t_0$, $u=u_0$, $V=V_0$, $W=W_0$ and $x=x_0*Z$, where the measurements a-x represent body length, high point shoulder to apex point of the breast, chest width, bottom width, waist, cross front, cross shoulder, cross back, armhole opening, sleeve length, armhole bottom to waist, cuff opening, cuff width, sleeve placket length, sleeve placket width, back neck width, front neck drop, back neck drop, collar band width, collar width, collar spread, center front placket width, yoke and sweep, respectively, the measurements $a_0$-$x_0$ represent the measurements a-x in the first size, and the adjusting is made according to the following formula:

if the second size is designed for a wearer of bra cup size A, then Q=99.7%, R=97.5%, S=97.9%, T=98.7%, U=98.4%, V=98.9%, W=99.1%, X=99.1%, Y=99.3%, Z=98.9%;

if the second size is designed for a wearer of bra cup size C, then Q=100.3%, R=102.5%, S=103.6%, T=101.3%, U=101.6%, V=101.1%, W=100.9%, X=100.9%, Y=100.7%, Z=101.1%;

if the second size is designed for a wearer of bra cup size D, then Q=100.6%, R=104.9%, S=107%, T=102.5%, U=103.3%, V=102.1%, W=101.7%, X=101.9%, Y=101.3%, Z=102.2%;

if the second size is designed for a wearer of bra cup size DD, then Q=101%, R=109.7%, S=110.4%, T=104.4%, U=105.6%, V=1031%, W=102.5%, X=102.8%, Y=102%, Z=103.9%;

if the second size is designed for a wearer of bra cup size F, then Q=103.2%, R=115.7%, S=111.3%, T=105.8%, U=106.8%, V=103.3%, W=103%, X=103%, Y=104.2%, Z=105%;

if the second size is designed for a wearer of bra cup size G, then Q=104.1%, R=117.8%, S=111.5%, T=107.3%, U=108.6%, V=104.1%, W=103.7%, X=103.8%, Y=105.4%, Z=106.1%;

if the second size is designed for a wearer of bra cup size B, then Q=R=S=T=U=V=W=X=Y=Z=100%;

and if the second size is designed for a wearer of height less than five feet and two inches, then K=−3.5", L=−0.875", M=−3.5", N=−1.75";

if the second size is designed for a wearer of height greater than or equal to five feet and two inches and less than five feet and six inches, then K=−2", L=−0.5", M=−2', N=−1";

if the second size is designed for a wearer of height greater than or equal to five feet and eleven inches, then K=2", L=0.5", M=2", N=1";

if the second size is designed for a wearer of height greater than or equal to five feet and six inches and less than five feet and eleven inches, then K=L=M=N=0;

and any one or more of a-x may vary +/−2%.

15. The outer garment of claim 9, wherein the outer garment is at least one of a:

shirt;
woven top;
cut-and-sew knit top;
fully-fashioned knit top;
jacket;
coat;
blazer;
outerwear;
shirt-dress;
dress;
gown;
t-shirt;
polo shirt;
sweater;
sweatshirt; and
tank top.

16. The outer garment of claim 9, wherein the outer garment is formed of at least one of a woven fabric, a knit fabric, knitted yarns, a lace material, a cotton material, a polyester material, a denim material, a leather material, a suede material, a natural fur material, a synthetic fur material, a linen material, a wool material, a corduroy material and materials comprising natural or synthetic blended fibers.

17. A method for designing an outer garment that covers at least part of a wearer's upper body, with optimally adjusted measurements, comprising:

designing the outer garment in a first size;

creating the outer garment in a second size by adjusting at least one measurement of the outer garment in the first size to obtain the at least one measurement of the outer garment in the second size, and not adjusting at least one other measurement of the outer garment in the first size to obtain the at least one other measurement of the outer garment in the second size, wherein the first size is different than the second size in terms of bra cup size and length, and the adjustment is made based on a standardized set of corrections related to the bra cup size of the second size.

18. An outer garment that covers at least part of a wearer's upper body, with optimally adjusted measurements, comprising:

at least one measurement that is adjusted from the outer garment in a first size to create the outer garment in a second size;

at least one other measurement that is not adjusted from the outer garment in a first size to create the outer garment in the second size, wherein the first size is different than the second size in terms of bra cup size and length, and wherein the adjustment is made based on a standardized set of corrections related to the bra cup size of the second size.

* * * * *

UNITED STATES PATENT AND TRADEMARK OFFICE

CERTIFICATE OF CORRECTION

PATENT NO. : 7,325,317 B2
APPLICATION NO. : 11/446468
DATED : February 5, 2008
INVENTOR(S) : Rebecca W. Matchett et al.

It is certified that error appears in the above-identified patent and that said Letters Patent is hereby corrected as shown below:

Column 17, line 15, change "V=1031%" to read --V=103.1%--.

Column 18, line 35, change "$r=r_{0\ s}=_{s}0$" to read --$r=r_0$, $s=s_0$--.

Column 18, line 62, change "V=1031%" to read --V=103.1%--.

Signed and Sealed this

Tenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,325,317 B2
APPLICATION NO. : 11/446468
DATED : February 5, 2008
INVENTOR(S) : Rebecca W. Matchett et al.

It is certified that error appears in the above-identified patent and that said Letters Patent is hereby corrected as shown below:

Column 8, line 36, “M=-2',” should be --M=-2'',--.

Column 17, line 33, “M=-2',” should be --M=-2'',--.

Column 19, line 13, “M=-2',” should be --M=-2'',--.

Signed and Sealed this
Twenty-sixth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,325,317 B2
APPLICATION NO. : 11/446468
DATED : February 5, 2008
INVENTOR(S) : Rebecca W. Matchett et al.

It is certified that error appears in the above-identified patent and that said Letters Patent is hereby corrected as shown below:

In Drawings sheet 19 of 38

FIG. 8E, column B, row v, “0.000” should be -- 1.250 --.

FIG. 8E, column B, row w, “1.250” should be -- 0.000 --.

Signed and Sealed this
Thirtieth Day of August, 2011

David J. Kappos

David J. Kappos
*Director of the United States Patent and Trademark Office*